US010480329B2

(12) United States Patent
Spangler et al.

(10) Patent No.: US 10,480,329 B2
(45) Date of Patent: Nov. 19, 2019

(54) AIRFOIL TURN CAPS IN GAS TURBINE ENGINES

(71) Applicant: United Technologies Corporation, Farmington, CT (US)

(72) Inventors: Brandon W. Spangler, Vernon, CT (US); Dominic J. Mongillo, West Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 166 days.

(21) Appl. No.: 15/496,093

(22) Filed: Apr. 25, 2017

(65) Prior Publication Data

US 2018/0306036 A1 Oct. 25, 2018

(51) Int. Cl.

| | |
|---|---|
| ***F01D 25/12*** | (2006.01) |
| ***F01D 5/18*** | (2006.01) |
| ***F01D 9/04*** | (2006.01) |

(52) U.S. Cl.

CPC ..... *F01D 5/187* (2013.01); *F01D 9/041* (2013.01); *F01D 25/12* (2013.01); *F05D 2220/32* (2013.01); *F05D 2240/12* (2013.01); *F05D 2250/185* (2013.01); *F05D 2260/20* (2013.01)

(58) Field of Classification Search

CPC . F01D 5/187; F01D 9/06; F01D 9/065; F01D 9/041; F01D 25/12; F05D 2250/185; F05D 2220/32; F05D 2240/12; F05D 2260/20

See application file for complete search history.

(56) References Cited

U.S. PATENT DOCUMENTS

| | | | |
|---|---|---|---|
| 4,257,737 | A | 3/1981 | Andress et al. |
| 5,393,198 | A | 2/1995 | Noda et al. |
| 5,511,309 | A | 4/1996 | Beabout |
| 5,525,038 | A | 6/1996 | Sharma et al. |

(Continued)

FOREIGN PATENT DOCUMENTS

| | | | |
|---|---|---|---|
| EP | 0735240 | A1 | 10/1996 |
| EP | 3106621 | A2 | 12/2016 |

(Continued)

OTHER PUBLICATIONS

European Search Report, European Application No. 18158460.8, dated Jul. 11, 2018, EP Patent Office; EP Search Report 11 pages.

*Primary Examiner* — Peter J Bertheaud
*Assistant Examiner* — Dnyanesh G Kasture
(74) *Attorney, Agent, or Firm* — Cantor Colburn LLP

(57) ABSTRACT

Turn caps for airfoils of gas turbine engines having exterior side walls, an exterior top wall extending between the exterior side walls, a first turn cap divider extending from the exterior top wall and positioned between the exterior side walls and defining a first turning feature between the first turn cap divider and the exterior side walls, the first turning feature comprising a first suction-side turn passage and a first pressure-side turn passage wherein the first turn cap divider fluidly separates the first pressure-side turn passage from the first suction-side turn passage within the turn cap, and a merging chamber is formed in the turn cap wherein fluid flows passing through the first suction side turn passage and the first pressure side turn passage are merged at the merging chamber.

12 Claims, 13 Drawing Sheets

(56) References Cited

U.S. PATENT DOCUMENTS

| | | | | |
|---|---|---|---|---|
| 6,126,394 | A | 10/2000 | Matsuda | |
| 6,299,412 | B1 | 10/2001 | Wood et al. | |
| 7,785,072 | B1 | 8/2010 | Liang et al. | |
| 8,192,153 | B2 | 6/2012 | Harvey et al. | |
| 8,202,054 | B2 | 6/2012 | Liang | |
| 8,292,582 | B1 * | 10/2012 | Liang | F01D 5/187 416/1 |
| 8,511,999 | B1 * | 8/2013 | Kimmel | F01D 5/147 416/193 A |
| 8,562,295 | B1 * | 10/2013 | Liang | F01D 5/14 29/889.21 |
| 8,602,741 | B2 | 12/2013 | Ahmad et al. | |
| 8,678,766 | B1 * | 3/2014 | Liang | F01D 5/187 416/97 R |
| 8,821,111 | B2 * | 9/2014 | Gear | F01D 5/187 415/115 |
| 8,864,438 | B1 | 10/2014 | Lee et al. | |
| 8,870,524 | B1 | 10/2014 | Liang | |
| 9,550,267 | B2 | 1/2017 | Beckman et al. | |
| 9,631,499 | B2 | 4/2017 | Liang | |
| 2005/0276698 | A1 | 12/2005 | Kvasnak et al. | |
| 2006/0222495 | A1 * | 10/2006 | Liang | F01D 5/186 416/97 R |
| 2007/0258825 | A1 * | 11/2007 | Shadbolt | B23P 6/002 416/223 R |
| 2009/0068023 | A1 | 3/2009 | Liang | |
| 2009/0148287 | A1 | 6/2009 | Suciu et al. | |
| 2009/0324423 | A1 | 12/2009 | Liang | |
| 2010/0054915 | A1 | 3/2010 | Devore et al. | |
| 2010/0226789 | A1 * | 9/2010 | Liang | F01D 5/186 416/97 R |
| 2011/0058949 | A1 * | 3/2011 | Marra | B21C 23/085 416/233 |
| 2014/0050893 | A1 | 2/2014 | Paige et al. | |
| 2014/0083116 | A1 * | 3/2014 | Crites | F01D 5/187 60/806 |
| 2014/0169962 | A1 * | 6/2014 | Lee | F01D 5/186 416/1 |
| 2016/0069184 | A1 * | 3/2016 | Ribic | B23K 26/0626 416/95 |
| 2016/0312632 | A1 * | 10/2016 | Hagan | F01D 9/041 |
| 2016/0376897 | A1 | 12/2016 | Spangler | |
| 2018/0195397 | A1 | 7/2018 | Spangler | |
| 2018/0223676 | A1 | 8/2018 | Spangler et al. | |
| 2018/0320531 | A1 | 11/2018 | Spangler et al. | |

FOREIGN PATENT DOCUMENTS

| | | | |
|---|---|---|---|
| EP | 3109405 | A1 | 12/2016 |
| EP | 3128130 | A1 | 2/2017 |
| EP | 3184738 | A1 | 6/2017 |
| EP | 3184745 | A1 | 6/2017 |
| EP | 3284908 | A2 | 2/2018 |

* cited by examiner

AIRFOIL TURN CAPS IN GAS TURBINE ENGINES

STATEMENT REGARDING FEDERALLY SPONSORED RESEARCH OR DEVELOPMENT

This invention was made with government support under Contract No. FA8650-09-D-2923-0021 awarded by the U.S. Air Force. The government has certain rights in the invention.

BACKGROUND

The subject matter disclosed herein generally relates to cooling flow in airfoils of gas turbine engines and, more particularly, to airfoil turn caps for cooling flow passages within airfoils in gas turbine engines.

In gas turbine engines, cooling air may be configured to flow through an internal cavity of an airfoil to prevent overheating. Gas temperature profiles are usually hotter at the outer diameter than at the inner diameter of the airfoils. In order to utilize cooling flow efficiently and minimize heat pickup and pressure loss, the cross-sectional area of the internal cooling flow may be configured to vary so that Mach numbers remain low where heat transfer is not needed (typically the inner diameter) and high Mach numbers where heat transfer is needed (typically the outer diameter). To do this in a casting, the walls of the airfoils tend to be thick in some areas and thin in other areas, which may add weight to the engine in which the airfoils are employed. Previously, baffles have been used to occupy some of the space within the internal cavity of the airfoils, referred to herein as "space-eater" baffles. The baffles extend from one end of the cavity all the way through the other end of the cavity within the airfoil. This configuration may result in relatively high Mach numbers to provide cooling throughout the cavity. Further, such configuration may provide high heat transfer, and pressure loss throughout the cavity.

In order to achieve metal temperatures required to meet full life with the cooling flow allocated, the "space-eater" baffles are required to be used inside an airfoil serpentine cooling passage. The serpentine turns are typically located outside gas path endwalls to allow the "space-eater" baffles to extend all the way to the gas path endwall (e.g., extend out of the cavity of the airfoil). However, because the airfoil may be bowed, the turn walls must also follow the arc of the bow to provide clearance for the "space-eater" baffles to be inserted. During manufacture, because the wax die end blocks do not have the same pull direction as the bow of the airfoil, the turn walls cannot be cast without creating a die-lock situation and trapping the wax die.

Thus it is desirable to provide means of controlling the heat transfer and pressure loss in airfoils of gas turbine engines, particularly at the endwall turn for serpentine gas paths.

SUMMARY

According to some embodiments, airfoils of gas turbine engines are provided. The airfoils include a hollow body defining a first up-pass cavity and a first down-pass cavity, the hollow body having an inner diameter end and an outer diameter end, the first up-pass cavity including a first pressure side airfoil passage and a first suction side airfoil passage, a first airfoil platform at one of the inner diameter end and the outer diameter end of the hollow body, the first airfoil platform having a gas path surface and a non-gas path surface, wherein the hollow body extends from the gas path surface, a first up-pass cavity opening formed in the non-gas path surface of the first airfoil platform fluidly connected to the first up-pass cavity, a first down-pass cavity opening formed in the non-gas path surface of the first airfoil platform fluidly connected to the first down-pass cavity, and a first turn cap fixedly attached to the first airfoil platform on the non-gas path surface covering the first up-pass cavity opening and the first down-pass cavity opening of the first airfoil platform. The first turn cap has exterior side walls, an exterior top wall extending between the exterior side walls, a first turn cap divider extending from the exterior top wall and positioned between the exterior side walls and defining a first turning feature between the first turn cap divider and the exterior side walls, the first turning feature comprising a first suction-side turn passage and a first pressure-side turn passage wherein the first turn cap divider fluidly separates the first pressure-side turn passage from the first suction-side turn passage within the turn cap, and a merging chamber is formed in the turn cap wherein fluid flows passing through the first suction side turn passage and the first pressure side turn passage are merged at the merging chamber.

In addition to one or more of the features described herein, or as an alternative, further embodiments of the airfoils may include a second turn cap divider extending from the exterior top wall and positioned between the exterior side walls and the first turn cap divider and defining a second turning feature between the second turn cap divider and the exterior side walls, the second turning feature comprising a second suction side turn passage and a second pressure side turn passage, wherein fluid flows through the second suction side turn passage and the second pressure side turn passage are merged at the merging chamber.

In addition to one or more of the features described herein, or as an alternative, further embodiments of the airfoils may include that the first pressure-side turn passage and the first suction-side turn passage each turn radially extending up-pass cavities having low aspect ratios into axially extending turn passages having similar aspect ratios.

In addition to one or more of the features described herein, or as an alternative, further embodiments of the airfoils may include that the hollow body further includes a second up-pass cavity having a second pressure side airfoil passage and a second suction side airfoil passage, a second up-pass cavity opening is formed in the non-gas path surface of the first airfoil platform fluidly connected to the second up-pass cavity. The first turn cap includes a second pressure-side turn passage fluidly connecting the second pressure side airfoil passage to the merging chamber when the turn cap is attached to the first airfoil platform and a second suction-side turn passage fluidly connecting the first suction side airfoil passage to the merging chamber when the turn cap is attached to the first airfoil platform. Each of the second suction-side turn passage and the second pressure-side turn passage turn a direction of fluid flow from a first direction to a second direction such that a fluid flow exiting the second suction-side turn passage and the second pressure-side turn passage are aligned when entering the merging chamber.

In addition to one or more of the features described herein, or as an alternative, further embodiments of the airfoils may include that the hollow body, the first airfoil platform, and the first turn cap are integrally formed.

In addition to one or more of the features described herein, or as an alternative, further embodiments of the airfoils may include that the first up-pass cavity defines a first geometry within the hollow body such that an airfoil external wall of the hollow body is substantially uniform in thickness at a first radial position and a second geometry within the hollow body such that the airfoil external wall of the hollow body is non-uniform in thickness at a second radial position.

In addition to one or more of the features described herein, or as an alternative, further embodiments of the airfoils may include that the second radial position is proximate the first airfoil platform.

In addition to one or more of the features described herein, or as an alternative, further embodiments of the airfoils may include a "space-eater" baffle positioned in the first up-pass cavity.

In addition to one or more of the features described herein, or as an alternative, further embodiments of the airfoils may include that the first pressure-side turn passage and the first suction-side turn passage are angled inward within the turn cap from a forward end of the turn cap toward an aft-end of the turn cap.

In addition to one or more of the features described herein, or as an alternative, further embodiments of the airfoils may include that the turn cap further comprises a second pressure-side turn passage and a second suction-side turn passage, wherein a second divider fluidly separates the second turn passages from the first turn passages.

In addition to one or more of the features described herein, or as an alternative, further embodiments of the airfoils may include that the first pressure-side turn passage fluidly connects the first pressure side airfoil passage to the merging chamber when the turn cap is attached to the first airfoil platform and the first suction-side turn passage fluidly connects the first suction side airfoil passage to the merging chamber when the turn cap is attached to the first airfoil platform, wherein each of the first suction-side turn passage and the first pressure-side turn passage turn a direction of fluid flow from a first direction to a second direction such that a fluid flow exiting the first suction-side turn passage and the first pressure-side turn passage are aligned when entering the merging chamber.

In addition to one or more of the features described herein, or as an alternative, further embodiments of the airfoils may include that the turn cap further includes at least one alignment tab extending from the turn cap to aid in positioning the turn cap relative to the hollow body or the first airfoil platform.

According to some embodiments, airfoils of gas turbine engines are provided. The airfoils include a hollow body having a plurality of up-pass cavities and at least one down-pass cavity extending between an inner diameter and an outer diameter, a platform at one of the inner diameter end and the outer diameter end of the hollow body, the platform having a gas path surface and a non-gas path surface, wherein the hollow body extends from the gas path surface, and a turn cap fixedly attached to the platform on the non-gas path surface. The turn cap includes a merging chamber fluidly connected to the at least one down-pass cavity when the turn cap is attached to the platform, a first pressure-side turn passage and a first suction-side turn passage fluidly connecting a first up-pass cavity to the merging chamber when the turn cap is attached to the first airfoil platform, a first turn cap divider fluidly separating and positioned between the first pressure-side turn passage and the first suction-side turn passage, and a second pressure-side turn passage and a second suction-side turn passage fluidly connecting a second up-pass cavity to the merging chamber when the turn cap is attached to the first airfoil platform, a second turn cap divider fluidly separating and positioned between the second pressure-side turn passage and second suction-side turn passage. Each of the first and second suction-side turn passages and the first and second pressure-side turn passages turn a direction of fluid flow from a first direction to a second direction such that a fluid flow exiting the first and second suction-side turn passages and the first and second pressure-side turn passages are all aligned when entering the merging chamber.

In addition to one or more of the features described herein, or as an alternative, further embodiments of the airfoils that a first divider fluidly separates the first pressure-side turn passage and the first suction-side turn passage until the first turn passages reach the merging chamber.

In addition to one or more of the features described herein, or as an alternative, further embodiments of the airfoils that the turn cap further comprises a second divider fluidly separating the second turn passages from the first turn passages.

According to some embodiments, turn caps for airfoils of gas turbine engines are provided. The turn caps include exterior side walls, an exterior top wall extending between the exterior side walls, a first turn cap divider extending from the exterior top wall and positioned between the exterior side walls and defining a first turning feature between the first turn cap divider and the exterior side walls, the first turning feature comprising a first suction-side turn passage and a first pressure-side turn passage wherein the first turn cap divider fluidly separates the first pressure-side turn passage from the first suction-side turn passage within the turn cap, and a merging chamber is formed in the turn cap wherein fluid flows passing through the first suction side turn passage and the first pressure side turn passage are merged at the merging chamber.

In addition to one or more of the features described herein, or as an alternative, further embodiments of the turn caps may include that the first turn cap divider has a tapering geometry extending from inlets of the pressure-side and suction-side turn passages of the first turning feature toward the merging chamber.

In addition to one or more of the features described herein, or as an alternative, further embodiments of the turn caps may include a second turning feature within the turn cap, the second turning feature including a second suction-side turn passage and a second pressure-side turn passage and a second turn cap divider including a portion separating the pressure-side turn passage of the first turning feature from the pressure-side turn passage of the second turning feature and a portion separating the suction-side turn passage of the first turning feature from the suction-side turn passage of the second turning feature. Each of the first turning feature and the second turning feature turn the direction of fluid flow from a first direction to a second direction such that a fluid flow exiting the first and second turning features are aligned when entering the merging chamber In addition to one or more of the features described herein, or as an alternative, further embodiments of the turn caps may include an integrally formed airfoil platform.

In addition to one or more of the features described herein, or as an alternative, further embodiments of the turn caps may include an integrally formed "space eater" baffle.

Technical effects of embodiments of the present disclosure include turn caps to be installed to or formed with platforms of airfoils to provide turning paths to improve the convective cooling of the airfoil within airfoil bodies and more particularly aid in turning airflows to enable low- or no-loss merging of multiple air streams within a turn cap.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
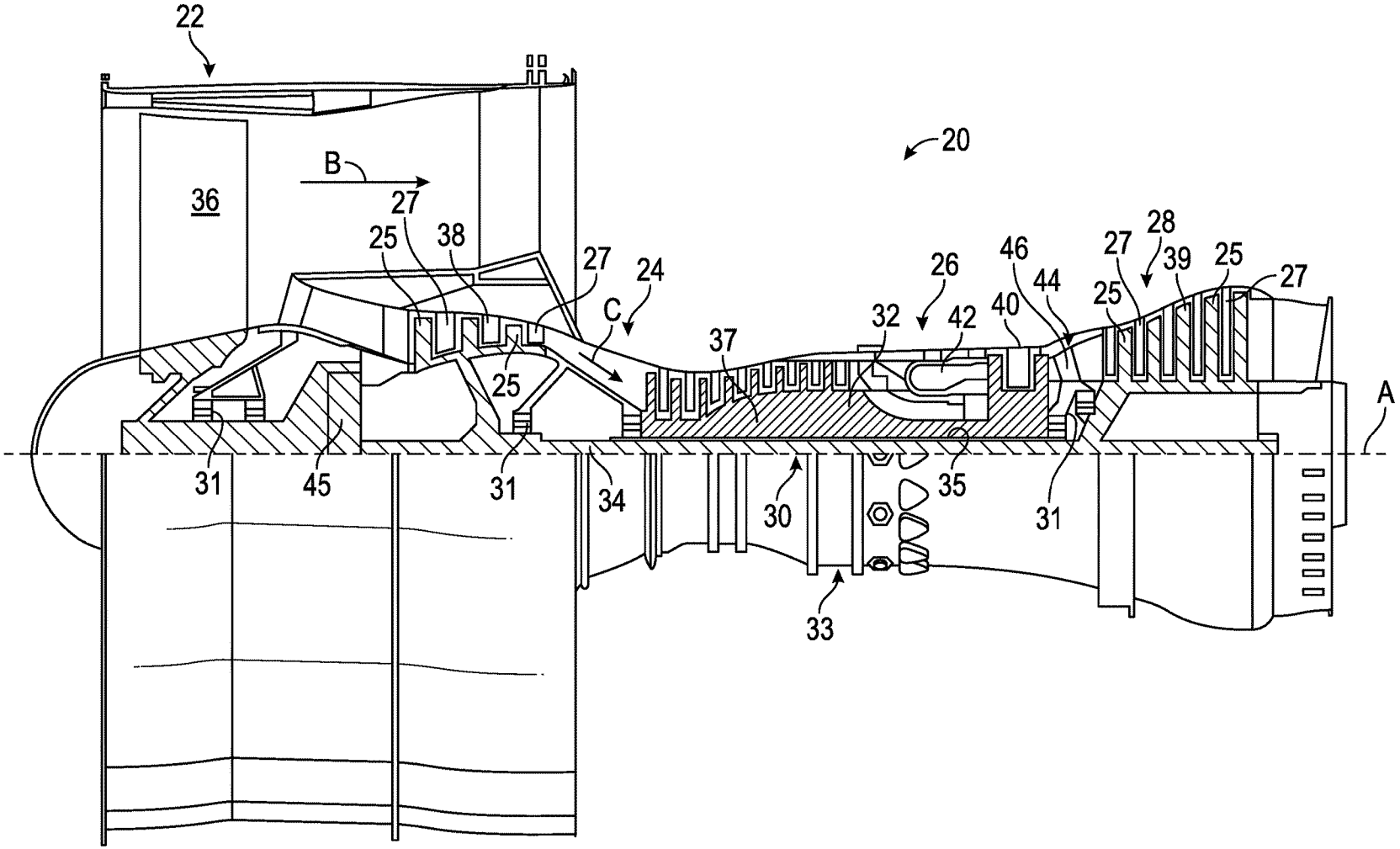
FIG. 1A is a schematic cross-sectional view of a gas turbine engine that may employ various embodiments disclosed herein.

FIG. 1A schematically illustrates a gas turbine engine 20. The exemplary gas turbine engine 20 is a two-spool turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, single-spool, three-spool, etc. engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

The pressure ratio of the low pressure turbine 39 can be pressure measured prior to the inlet of the low pressure turbine 39 as related to the pressure at the outlet of the low pressure turbine 39 and prior to an exhaust nozzle of the gas turbine engine 20. In one non-limiting embodiment, the bypass ratio of the gas turbine engine 20 is greater than about ten (10:1), the fan diameter is significantly larger than that of the low pressure compressor 38, and the low pressure turbine 39 has a pressure ratio that is greater than about five (5:1). It should be understood, however, that the above parameters are only examples of one embodiment of a geared architecture engine and that the present disclosure is applicable to other gas turbine engines, including direct drive turbofans.

In this embodiment of the example gas turbine engine 20, a significant amount of thrust is provided by the bypass flow path B due to the high bypass ratio. The fan section 22 of the gas turbine engine 20 is designed for a particular flight condition—typically cruise at about 0.8 Mach and about 35,000 feet. This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan Pressure Ratio is the pressure ratio across a blade of the fan section 22 without the use of a Fan Exit Guide Vane system. The low Fan Pressure Ratio according to one non-limiting embodiment of the example gas turbine engine 20 is less than 1.45. Low Corrected Fan Tip Speed is the actual fan tip speed divided by an industry standard temperature correction of [(Tram ° R)/(518.7° R)]0.5, where T represents the ambient temperature in degrees Rankine. The Low Corrected Fan Tip Speed according to one non-limiting embodiment of the example gas turbine engine 20 is less than about 1150 fps (351 m/s).

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation. Example cooling circuits that include features such as partial cavity baffles are discussed below.

Figure 1B:
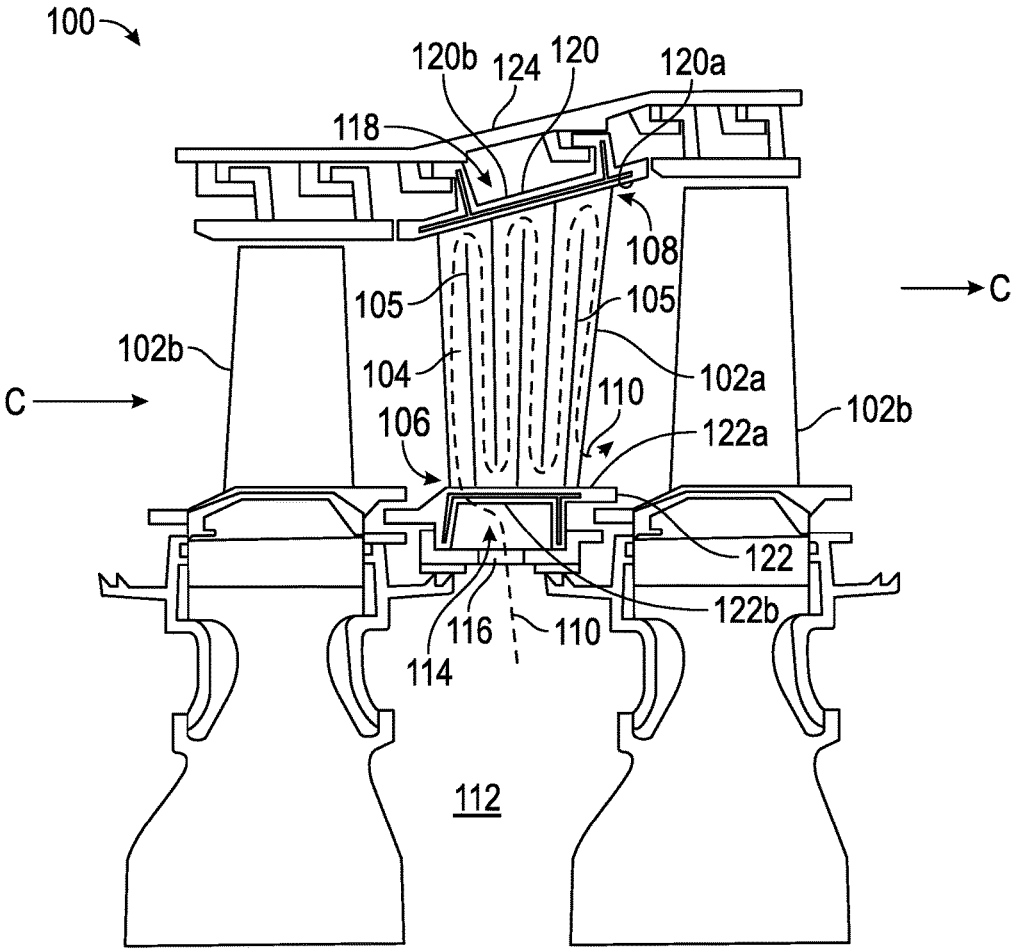
FIG. 1B is a partial schematic view of a turbine section of the gas turbine engine of FIG. 1A.

FIG. 1B is a partial schematic view of a turbine section 100 that may be part of the gas turbine engine 20 shown in FIG. 1A. Turbine section 100 includes one or more airfoils 102*a*, 102*b*. As shown, some airfoils 102*a* are stationary stator vanes and other airfoils 102*b* are blades of turbines disks. The airfoils 102*a*, 102*b* are hollow body airfoils with one or more internal cavities defining a number of cooling channels 104 (schematically shown in vane 102*a*). The airfoil cavities 104 are formed within the airfoils 102*a*, 102*b* and extend from an inner diameter 106 to an outer diameter 108, or vice-versa. The airfoil cavities 104, as shown in the vane 102*a*, are separated by partitions 105 that extend either from the inner diameter 106 or the outer diameter 108 of the vane 102*a*. The partitions 105, as shown, extend for a portion of the length of the vane 102*a* to form a serpentine passage within the vane 102*a*. As such, the partitions 105 may stop or end prior to forming a complete wall within the vane 102*a*. Thus, each of the airfoil cavities 104 may be fluidly connected. In other configurations, the partitions 105 can extend the full length of the respective airfoil. Although not shown, those of skill in the art will appreciate that the blades 102*b* can include similar cooling passages formed by partitions therein.

As shown, counting from a leading edge on the left, the vane 102*a* may include six airfoil cavities 104 within the hollow body: a first airfoil cavity on the far left followed by a second airfoil cavity immediately to the right of the first airfoil cavity and fluidly connected thereto, and so on. Those of skill in the art will appreciate that the partitions 105 that separate and define the airfoil cavities 104 are not usually visible and FIG. 1B is merely presented for illustrative and explanatory purposes.

The airfoil cavities 104 are configured for cooling airflow to pass through portions of the vane 102*a* and thus cool the vane 102*a*. For example, as shown in FIG. 1B, an airflow path 110 is indicated by a dashed line. In the configuration of FIG. 1B, air flows from a rotor cavity 112 and into an airfoil inner diameter cavity 114 through an orifice 116. The air then flows into and through the airfoil cavities 104 as indicated by the airflow path 110. Positioned at the outer diameter of the airfoil 102, as shown, is an outer diameter cavity 118.

As shown in FIG. 1B, the vane 102*a* includes an outer diameter platform 120 and an inner diameter platform 122. The vane platforms 120, 122 are configured to enable attachment within and to the gas turbine engine. For example, as appreciated by those of skill in the art, the inner diameter platform 122 can be mounted between adjacent rotor disks and the outer diameter platform 120 can be mounted to a case 124 of the gas turbine engine. As shown, the outer diameter cavity 118 is formed between the case 124 and the outer diameter platform 120. Those of skill in the art will appreciate that the outer diameter cavity 118 and the inner diameter cavity 114 are outside of or separate from the core flow path C. The cavities 114, 118 are separated from the core flow path C by the platforms 120, 122. Thus, each platform 120, 122 includes a respective core gas path surface 120*a*, 122*a* and a non-gas path surface 120*b*, 122*b*. The body of the vane 102*a* extends from and between the gas path surfaces 120*a*, 122*a* of the respective platforms 120, 122. In some embodiments, the platforms 120, 122 and the body of the vane 102*a* are a unitary body.

Air is passed through the airfoil cavities of the airfoils to provide cooling airflow to prevent overheating of the airfoils and/or other components or parts of the gas turbine engine. The flow rate through the airfoil cavities may be a relatively low flow rate of air and because of the low flow rate, the convective cooling and resultant internal heat transfer coefficient may be too low to achieve the desired metal temperatures of the airfoils. One solution to this is to add one or more baffles into the airfoil cavities. That is, in order to achieve desired metal temperatures to meet airfoil full-life with the cooling flow allocated based on turbine engine design, "space-eater" baffles may be used inside airfoil serpentine cooling passages (e.g., within the airfoil cavities 104 shown in FIG. 1B). In this instance, the "space-eater" baffle serves as a way to consume internal cavity area/volume in order to reduce the available cross-sectional area through which air can flow. This enables the local flow per unit area to be increased which in turn results in higher cooling cavity Reynolds Numbers and internal convective heat transfer. In some of these configurations, the serpentine turns must be located outside the gas path endwalls (e.g., outside of the airfoil body) to allow the "space-eater" baffles to extend all the way to the gas path endwall. That is, the "space-eater" baffles may be required to extend into the outer diameter cavity 118 or the inner diameter cavity 114. In some circumstances, depending upon the method of manufacture, the radial cooling cavities 104 must be accessible to allow for the insertion of the "space-eater" baffles. However, those of skill in the art will appreciate that if the airfoil cooling configurations are fabricated using alternative additive manufacturing processes and/or fugitive core casting processes the "space-eater" baffles may be fabricated as an integral part or component of the internal convective cooling design concurrently with the rest of the core body and cooling circuit.

Additionally, as will be appreciated by those of skill in the art, a cooling scheme generally requires the merging of cooling flow from several radial passages extending along the pressure and suction sides of the airfoil with minimum pressure loss. For example, a cooling flow from the leading edge-most passages of the airfoil must be able to deliver and provide cooling air to the trailing edge passage(s) with as little pressure loss as possible, in order to ensure positive outflow of the trailing edge exit slots, e.g., as traveling from the leading edge on the left of the airfoil 102*a* in FIG. 1B to the trailing edge on the right of the airfoil 102*a*. Alternatively, in some embodiments, the direction of the serpentine flow may flow from the trailing edge-most passages of the airfoil toward the leading edge passage(s) with as little pressure loss as possible. To avoid unnecessary turbulence generated by the merging of multi-directional air flow streams that are flowing with varying velocities and pressures, the cooling flow must remain in each passage as it transitions from radial flow to axial flow (e.g., moving in a direction from leading edge toward trailing edge of the airfoil or, conversely, from trailing edge toward the leading edge of the airfoil). Depending on the particular configuration of the turbine, housing, engine, etc., there may be a limited radial, axial, and/or circumferential distance to merge the cooling flow, particularly when transitioning from one direction or orientation of flow to another direction or orientation of flow.

In cooling passages, the channel defining the passage has an aspect ratio associated or defined by the dimensions of the channel that are perpendicular to the flow direction. As will be appreciated by those of skill in the art, the term aspect ratio is typically used to define the relationship between the dimensions of a channel perpendicular to the flow direction. As used herein, the name of an aspect ratio will refer to the orientation of the longest dimension perpendicular to the flow direction. For example, an "axial aspect ratio" means the longest dimension that is perpendicular to the flow direction (e.g., W1 in FIG. 2B) is in an axial orientation. A "circumferential aspect ratio" means the longest dimension that is perpendicular to the flow direction (e.g., W2 in FIG. 2C) is in a circumferential orientation. A "radial aspect ratio" means the longest dimension that is perpendicular to the flow direction is in a radial orientation.

For example, with reference to FIG. 1B, the leading edge passage of airflow path 110 through the airfoil 102*a* flows upward on the page from the inner diameter 106 to the outer diameter 108. Thus, in this instance, the airflow passing through the leading edge passage is in a radial flow direction. As such, the dimensions that define aspect ratio of the channel defining the leading edge passage would be in an axial orientation (i.e., left-to-right on the page) and a circumferential orientation (i.e., in and out of the page). In one example, for illustrating and explaining the nomenclature related to aspect ratios, the axial dimension of this leading channel is longer than the circumferential dimension. That is, the left-to-right dimension is longer than the dimension of the channel in the direction into/out of the page (e.g., from a pressure side to a suction side, as will be appreciated by those of skill in the art). Because the axial dimension is the longer of the dimensions that is perpendicular to a flow direction through the leading edge channel, the leading edge channel has an "axial aspect ratio."

Accordingly, as noted above and as used herein, the "name" of an aspect ratio is defined as the direction of the longest dimension of a channel that is perpendicular to a direction of flow through the channel (e.g., axial, radial, circumferential). Thus, as described above, an aspect ratio of a channel within an airfoil having air flowing from the inner diameter to the outer diameter has a radial flow direction. With a "space-eater" baffle installed within such an airfoil, the longest dimension that is perpendicular to the flow direction is the axially oriented dimension and the circumferentially oriented dimension is the shorter dimension. As such, the channel has an "axial aspect ratio." An axial aspect ratio can also have a direction of cooling flow in a circumferential direction, with the shorter dimension of the channel having a radial orientation. A "circumferential aspect ratio" channel is one that has a flow direction in either the radial or axial flow direction, with the longest dimension of the channel that is perpendicular to the flow direction having a circumferential orientation. Similarly, a "radial aspect ratio" channel is one that has an axial or circumferential flow direction, with the longest dimension of the channel that is perpendicular to the flow direction being radially oriented.

The above described limited radial distance at the turning of airflows passing through airfoils may alter the direction of the channels and, thus, the associated aspect ratios. For example when transitioning from a radial flow direction to an axial flow direction, a flow passage may transition from an axial aspect ratio channel to a circumferential aspect ratio channel. Once all the flow is travelling in the same direction, it can be merged.

Referencing FIGS. 2A-2D, schematic illustration of an airfoil 202 configured in accordance with an embodiment of the present disclosure is shown. The airfoil 202 may be a vane and similar to that shown and described above having a body that extends from an inner diameter platform 222 to an outer diameter platform 220. The airfoil 202 extends from a gas path surface 220*a* of the outer diameter platform 220 to a gas path surface 222*a* of the inner diameter platform 222.

The airfoil 202 includes a plurality of interior airfoil cavities, with an up-pass airfoil cavity 204*a* being an up-pass of a serpentine cavity, a down-pass airfoil cavity 204*b* being a down-pass of the serpentine cavity, and a trailing edge airfoil cavity 204*c*. The airfoil 202 also includes a leading edge airfoil cavity 204*d* at a leading edge thereof. As illustratively shown, a cooling flow of air can follow an airflow path 210 by entering the airfoil 202 from the inner diameter, flowing upward to the outer diameter through the up-pass of the up-pass airfoil cavity 204*a*, turning at the outer diameter turning cavity 246, downward through the down pass of the down-pass airfoil cavity 204*b*, turning at the inner diameter turning cavity 248, and then upward and out through the third airfoil cavity 204*c*. As shown, the up-pass and down-pass airfoil cavities 204*a*, 204*b* are configured with baffles 238*a*, 238*b* inserted therein.

To provide sufficient cooling flow and control of cooling air pressure within the airflow path 210, the airfoil 202 is provided with a first turn cap 242 and a second turn cap 244. The first turn cap 242 defines a first turning cavity 246 therein. Similarly, the second turn cap 244 defines a second turning cavity 248 therein. As illustratively shown, the first turn cap 242 is positioned at an outer diameter 208 of the airfoil 202 and fluidly connects the up-pass airfoil cavity 204*a* with the down-pass airfoil cavity 204*b*. The second turn cap 244 is positioned at an inner diameter 206 of the airfoil 202 and fluidly connects the down-pass airfoil cavity 204*b* with the third airfoil cavity 204*c*. The first and second turning cavities 246, 248 define portions of the cooling airflow path 210 used for cooling the airfoil 202. The turn caps 242, 244 are attached to respective non-gas path surfaces 220*b*, 222*b* of the platforms 220, 222.

The first and second turn caps 242, 244 move the turn of the airflow path 210 outside of the airfoil and into the cavities external to the airfoil (e.g., within outer diameter cavity 118 and inner diameter cavity 114 shown in FIG. 1B) and outside the hot gas path region which is typically constrained between the outer diameter and inner diameter gas path surfaces 120*a*, 122*a* of the respective platforms 120, 122, as shown in FIG. 1B. As such, there is significantly lower heat flux that exists outside of the hot gas path region. In this embodiment, the first and second turn caps 242, 244 serve as conduits for the internal cooling air flow to be transitioned toward the outer perimeter of the "space-eater" baffles 238*a*, 238*b*. In this instance, the "space eater" baffles consume a significant portion of the unobstructed cooling channels creating significantly smaller cooling channels within the up-pass cavity 204*a* immediately adjacent to the external airfoil wall surfaces along the entire radial distance of the airfoil surface (as shown in FIG. 2D). The redirection of cooling air flow around the perimeter of the "space-eater" baffles into the smaller cross-sectional area cooling channels within the up-pass cavity 204*a* enables significantly higher internal cooling air flow Reynolds Numbers to be obtained. The increase in cooling air flow per unit area results in a higher internal convective heat transfer coefficient to be achieved along the entire radial cooling cavity immediately adjacent to the surface of an airfoil external wall 205 within the body of the airfoil 202 (as shown in FIG. 2D). In this embodiment, the turn caps 242, 244 are manufactured as separate parts or pieces that are welded or otherwise fixedly attached to the platforms 220, 222.

As shown illustratively, the first turn cap 242 and the second turn cap 244 have different geometric shapes. The turn caps in accordance with the present disclosure can take various different geometric shapes such that a desired air flow and pressure loss characteristics can be achieved. For example, a curved turn cap may provide improved and/or controlled airflow at the turn outside of the airfoil body. Other geometries may be employed, for example, to accommodate other considerations within the gas turbine engine, such as fitting between the platform and a case of the engine. Further, various manufacturing considerations may impact turn cap shape. For example, flat surfaces are easier to fabricate using sheet metal, and thus it may be cost effective to have flat surfaces of the turn caps, while still providing sufficient flow control.

Figure 2A:
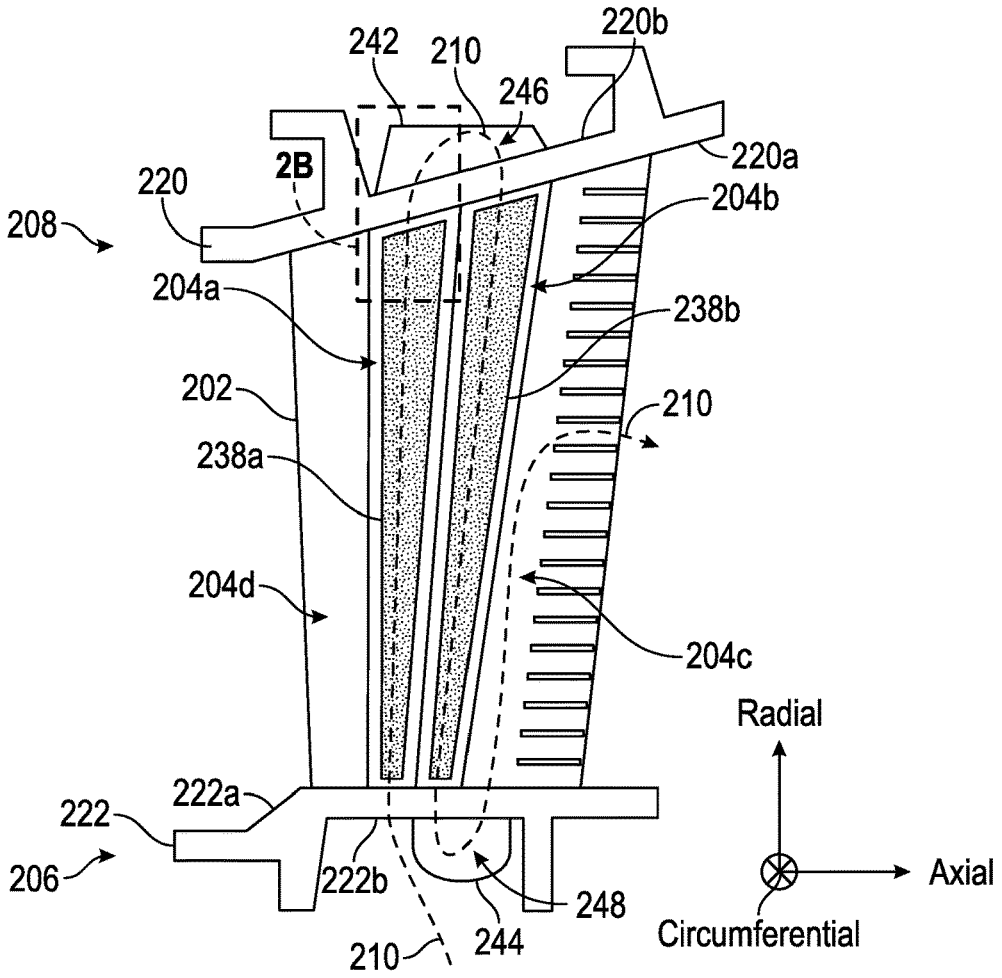
FIG. 2A is a schematic illustration of an airfoil configured in accordance with a non-limiting embodiment of the present disclosure.
Figure 2B:
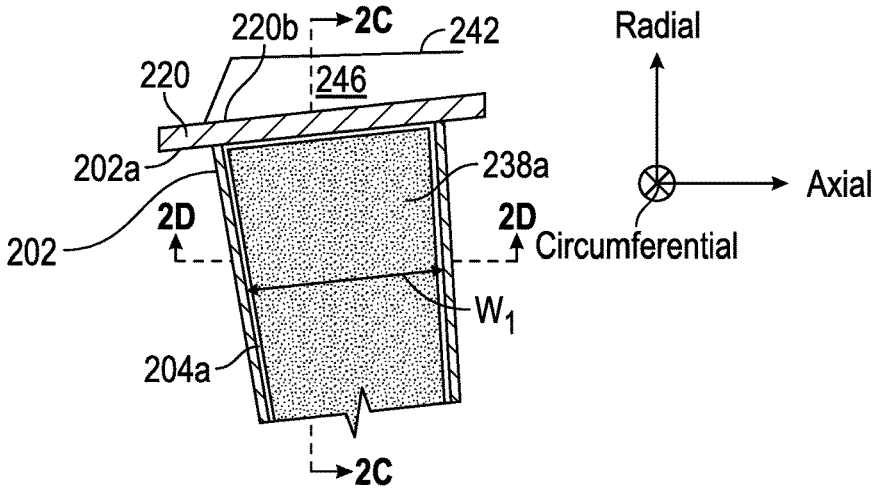
FIG. 2B is an enlarged illustration of a portion of the airfoil of FIG. 2A as indicated in the box 2B of FIG. 2A.
Figure 2C:
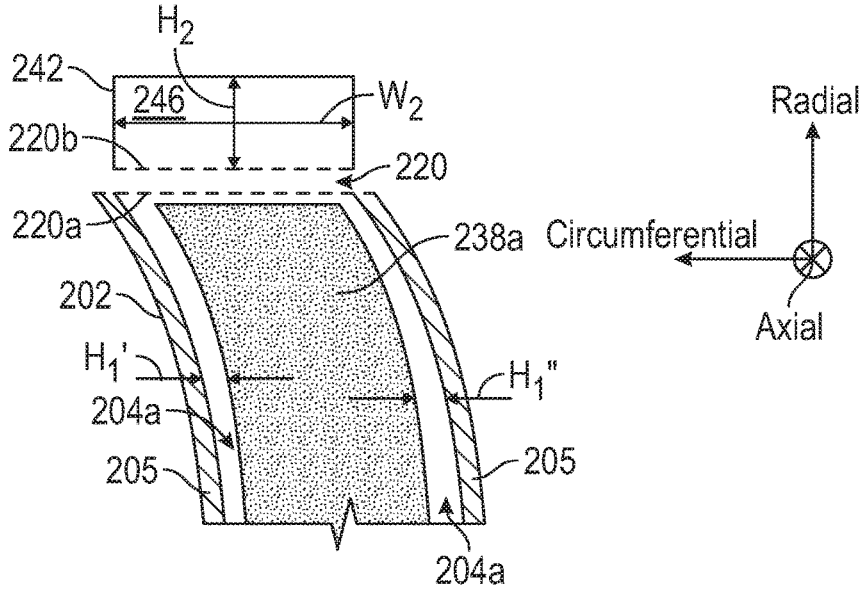
FIG. 2C is a cross-sectional illustration of the airfoil of FIG. 2A as viewed along the line 2C-2C of FIG. 2B.
Figure 2D:
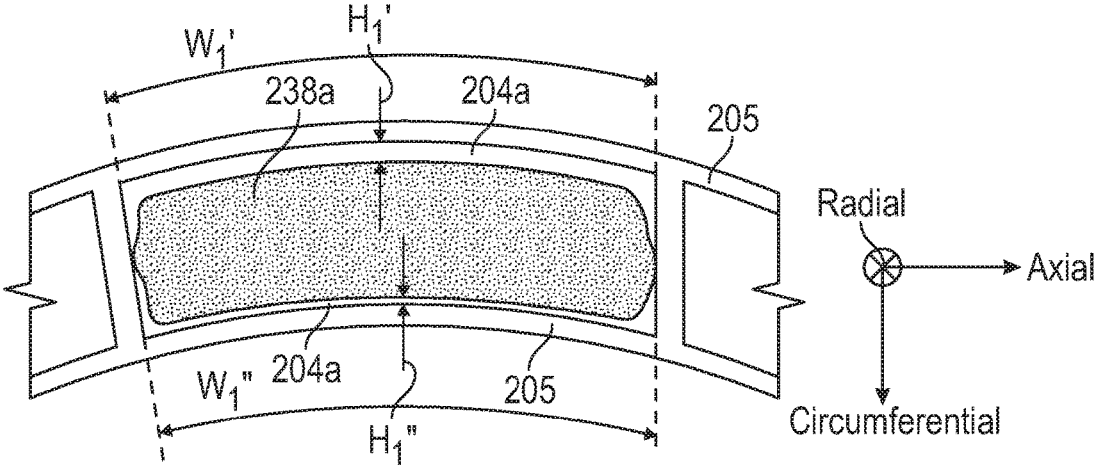
FIG. 2D is a cross-sectional illustration of the airfoil of FIG. 2A as viewed along the line 2D-2D of FIG. 2B.

As shown in FIGS. 2B-2C, enlarged illustrations of a portion of the airfoil 202 of FIG. 2A are shown. FIG. 2B illustrates an enlarged illustration of the box 2B indicated in FIG. 2A and FIG. 2C is a cross-sectional illustration along the line 2C-2C shown in FIG. 2B. As shown in FIG. 2B, the airfoil 202 includes the baffle 238*a* disposed within up-pass airfoil cavity 204*a*. The airfoil 202 extends radially inward (relative to an axis of an engine) as indicated by the key shown in FIGS. 2A-2C. In FIGS. 2A-2C, the radial direction is outward relative to an engine axis (e.g., engine centerline longitudinal axis A shown in FIG. 1A) and is illustrated as upward on the page of FIGS. 2A-2C. The axial direction is along the engine axis and is shown indicated to the right in FIGS. 2A-2B and into the page of FIG. 2C. Those of skill in the art will appreciate that a circumferential direction is to the left/right in FIG. 2C (into/out of page of FIGS. 2A-2B).

As shown in FIGS. 2B-2D, air flowing through the up-pass airfoil cavity 204*a* and into the first turning cavity 246 will change in aspect ratios with respect to the channel through which the flow passes. For example, when passing radially upward or outward within the up-pass airfoil cavity 204*a*, the airflow will pass through a channel (e.g., up-pass airfoil cavity 204*a*) defined by the airfoil external walls 205 and the baffle 238*a*. The up-pass airfoil cavity 204*a* and the baffle 238*a* define an axial aspect ratio of height-to-width of the channel. In this case the airflow channel has a first height H1', H1" which is a distance between a surface of the baffle 238*a* and a surface of an airfoil external wall 205 in the circumferential direction. As shown, and as will be appreciated by those of skill in the art, the first height H1', H1" can be different on the suction and pressure sides of the baffle 238*a*. However, in some embodiments, the first height H1', H1" is the same on both the pressure and suction airfoil external walls 205. As shown in FIGS. 2B-2D, the up-pass airfoil cavity 204*a* can have first width W1', W1", which as shown, is a distance in the substantially axial direction.

When the airflow passes into the first turn cap 242, the orientation of the aspect ratio changes to a circumferential aspect ratio channel. In this case, a second height H2 is the height of the first turn cap 242 from the non-gas path surface 220*b* of the platform 220. The width of the airflow channel within the first turn cap 242 (second width W2) is a distance between the pressure side and the suction side of the airfoil, as shown in FIG. 2C. As noted above, the limited radial height within the turn cap (e.g., second height H2) may alter the available aspect ratios for the flow passages and, thus, the flow passage(s) will transition from an axial aspect ratio (within the airfoil) to a circumferential aspect ratio (within the turn cap). Once all the flow is travelling in the same direction, it can be merged.

Figure 3:
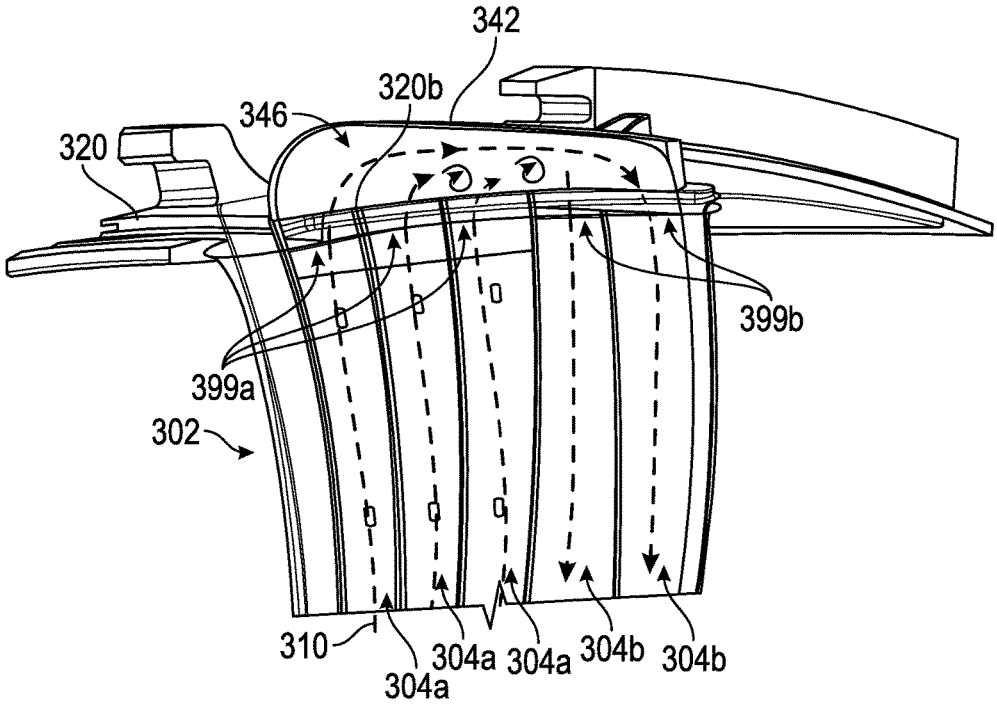
FIG. 3 is a schematic illustration of airflow through an airfoil having a turn cap installed thereto.

Turning now to FIG. 3, a schematic illustration of an airfoil 302 having a turn cap 342 mounted on a non-gas path surface 320*b* of a platform 320 is shown. FIG. 3 illustrates internal cooling passages of the airfoil 302 and airflow therethrough, and in this illustration without "space-eater" baffles for simplicity and clarity of illustration. Cavities of the airfoil 302 are fluidly connected to a turning cavity 346 within the turn cap 342 by means of cavity openings 399*a*, 399*b* that are formed in the platform 320.

As schematically shown, airflow 310 flows radially upward through the airfoil 302 along multiple up-pass airfoil cavities 304*a*. The airflow passes from the up-pass cavities 304*a* through respective cavity openings 399*a* and into the turning cavity 346 of the turn cap 342. To direct the airflow 310 through cavities 399*b* and into multiple down-pass cavities 304*b*, the turn cap 342 is provided. However, as shown, as the different branches of the airflow 310 enter the turn cap 342 and merge, turbulent mixing may arise, thereby inducing higher momentum mixing loss. That is, multiple air flow streams of varying velocities and pressures are merged and travel axially toward the trailing edge of the airfoil 302. Because the different flow streams of airflow 310 enter the turn cap 342 at different positions, some of the airflow will be moving axially (e.g., axially forward-entering air streams) while other streams will be flowing radially (e.g., axially aftward-entering air streams). As a result of the merging of multi-directional flow streams large eddies are generated (as schematically shown in FIG. 3) creating local turbulent vorticities which induce undesired pressure losses in the internal cooling air flow.

A cooling scheme requires the merging of cooling flow from several radial passages along the pressure and suction sides of the airfoil with minimum pressure loss. The cooling flow from the leading edge most passages must be able to get to the trailing edge passage with as little loss as possible. To avoid unnecessary turbulence generated by the merging of flow streams in different directions, the cooling flow must remain in each passage as it transitions from radial flow direction to axial flow direction. Once all the flow is travelling in the same direction, the separated flows can be merged.

Accordingly, as provided herein, turn caps are provided that turn radially extending passages (e.g., within an airfoil) with low aspect ratios (height/width) into axially extending passages (e.g., within the turn cap) with similar aspect ratios (e.g., within the turn cap). When the passage is radially extending within the airfoil, the width of the passage is in the axial direction. When the passage is axial within the turn cap, the width of the passage is in the radial direct. After the passages have been turned, the forward passages are segregated and offset behind the aft passages, using multiple ribs that are positioned circumferentially to separate the individual passages. In order to segregate and offset a forward passage behind an aft passage, the radial passages must be rotated slightly from traditional configurations. Such change can result in varying wall thicknesses and/or cavity heights of the turn cap. The cooling flow streams from each passage are merged together once the passages are pointed in the same streamwise direction, resulting in low loss.

Figure 4A:
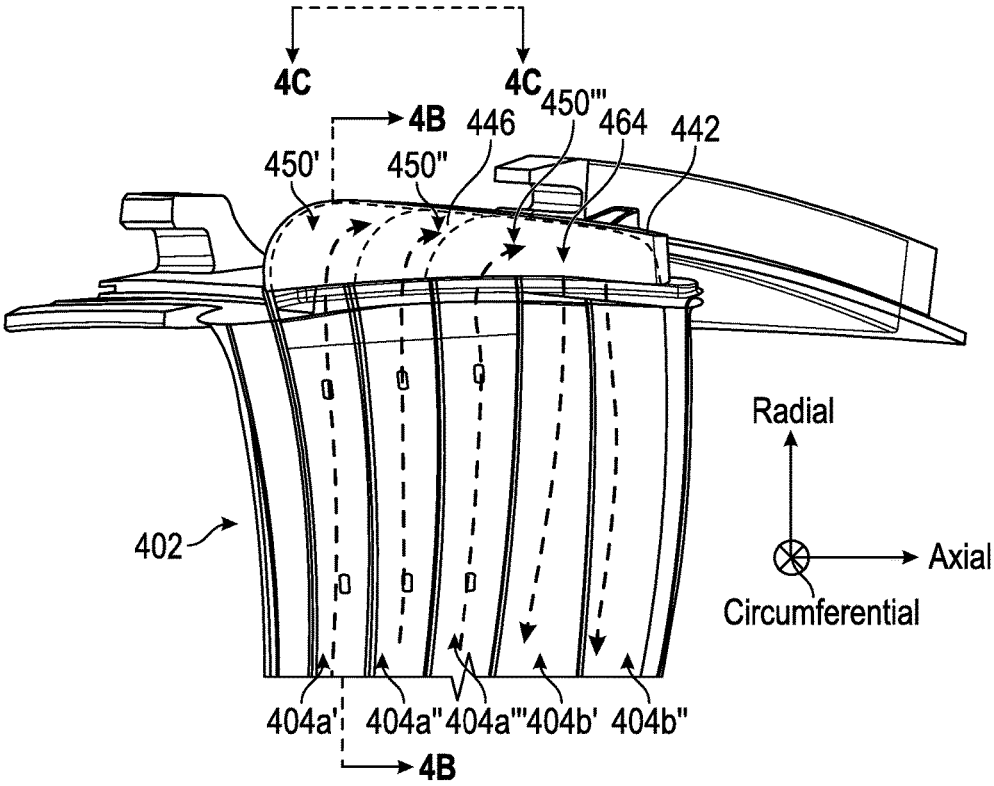
FIG. 4A is a schematic illustration of a turn cap in accordance with an embodiment of the present disclosure as attached to an airfoil.
Figure 4B:
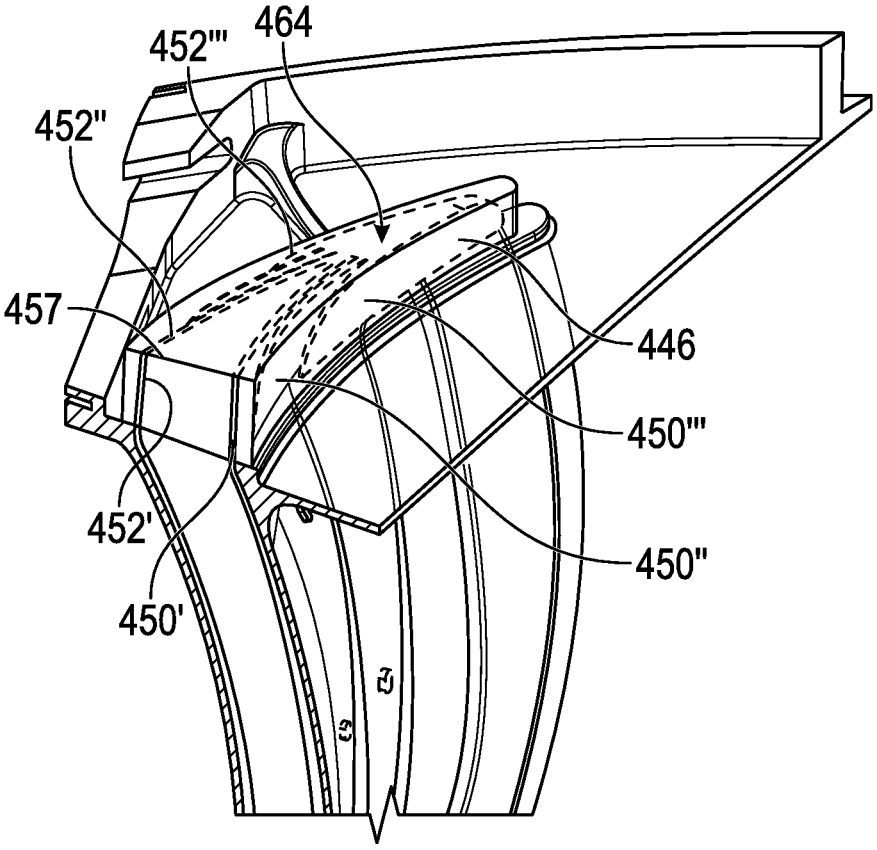
FIG. 4B is an isometric, cross-section illustration of the airfoil and turn cap of FIG. 4A as viewed along the line 4B-4B of FIG. 4A.
Figure 4C:
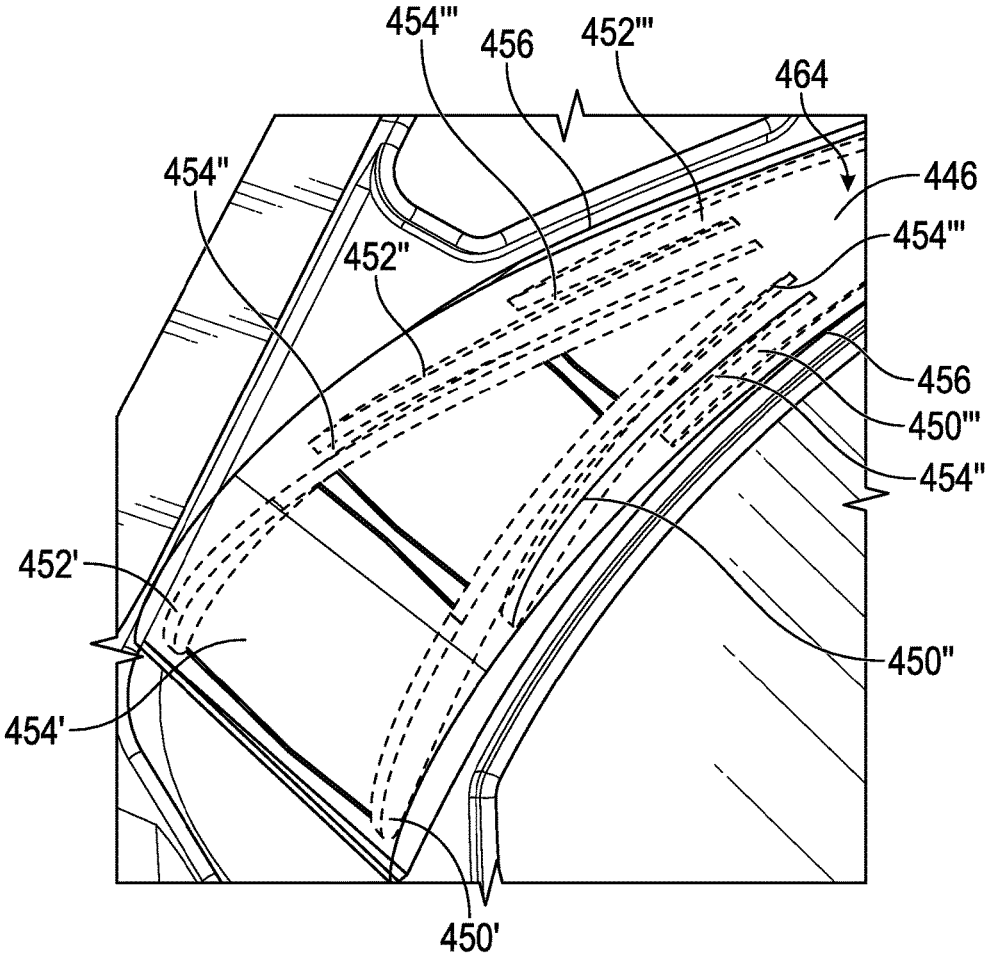
FIG. 4C is a top down, plan illustration of the turn cap of FIG. 4A as viewed along the line 4C-4C of FIG. 4A.

Turning now to FIGS. 4A-4C, schematic illustrations of an airfoil 402 configured with a turn cap 442 in accordance with an embodiment of the present disclosure are shown. FIG. 4A is a side view illustration of the airfoil 402 and the turn cap 442. FIG. 4A illustrates internal cooling passages of the airfoil 402 and airflow therethrough, and in this illustration without "space-eater" baffles for simplicity and clarity of illustration. FIG. 4B is an isometric, cross-section illustration viewed along the line 4B-4B shown in FIG. 4A. FIG. 4C is top-down, plan illustration of a portion of the turn cap 442 as viewed along the line 4C-4C in FIG. 4A. As shown, the airfoil 402 includes a plurality of up-pass cavities 404*a* and two down-pass cavities 404*b*. As shown, internal cooling air flows radially upward (outward) through the up-pass cavities 404*a*, turns within the turn cap 442, and is merged prior to flowing radially downward (inward) into and through the down-pass cavities 404*b*.

The turn cap 442 is arranged to keep the cooling flow streams in each passage (up-pass cavities 404*a*) segregated until all of the flow streams have turned axial and are flowing in the same direction (e.g., substantially parallel to each other). Such segregation in the turn can eliminate pressure losses associated with turbulence caused by the merging of multi-directional air flow streams that are flowing with varying velocities and pressures. In addition, embodiments provided herein enable a means of transitioning the cooling passages from an axial aspect ratio to a radial aspect ratio in order to fit all of the passages within the turn cap.

To separate the flow, the turn cap 442 is configured with multiple turning passages or cavities therein, with the turning passages or cavities separating or dividing up a turning cavity 446 within the turn cap 442. For example, as shown in FIGS. 4A-4C, the turning cavity 446 within the turn cap 442 includes a first pressure-side turn passage 450', a second pressure-side turn passage 450", and a third pressure-side turn passage 450'". Each of the pressure-side turn passages 450', 450", 450'" is fluidly connected to a pressure-side portion of a respective up-pass cavity 404*a*', 404*a*", 404*a*'". Similarly, the turning cavity 446 is separated on the suction side, having a first suction-side turn passage 452', a second suction-side turn passage 452", and third suction-side turn passage 452'". Each of the suction-side turn passages 452', 452", 452'" are fluidly connected to a suction-side portion of a respective up-pass cavity 404*a*', 404*a*", 404*a*'".

The first pressure-side turn passage 450' and the first suction-side turn passage 452' form a first turning feature that turns and orients the flows from the pressure and suction sides of the first up-pass 404*a*' toward a merging chamber 464 at an aftward end of the turn cap 446 (e.g., proximate the down-pass cavities 404*b*). As shown in FIGS. 4B-4C, in this non-limiting embodiment, the first turning feature is substantially V-shaped, with inlets of the respective first pressure-side turn passage 450' and first suction-side turn passage 452' apart from each other (essentially separation between pressure side and suction side of the airfoil 402 at the ends of the first up-pass airfoil cavity 404*a*'). As the first pressure-side turn passage 450' and the first suction-side turn passage 452' extend aftward from the inlet, the orientation of the passages 450', 452' taper or are angled inward toward each other converging in cavity cross-sectional flow area until the passages 450', 452' merge at the merging chamber 464.

Similarly, the second pressure-side turn passage 450" and the second suction-side turn passage 452" form a second turning feature that turns and orients the flows from the pressure and suction sides of the second up-pass 404*a*" toward the merging chamber 464. The second turning feature also forms a generally tapered V-shape orientation as shown in the embodiment of FIGS. 4A-4C. Inlets of the respective second pressure-side turn passage 450" and second suction-side turn passage 452" are separated apart from each other (essentially separation between pressure side and suction side of the airfoil 402 at the ends of the second up-pass airfoil cavity 404*a*"). As the second pressure-side turn passage 450" and the second suction-side turn passage 452" extend aftward from the respective inlets, the orientation of the passages 450", 452" taper or are angled inward toward each other until the passages 450", 452" merge or have outlets at the merging chamber 464. As shown in FIGS. 4B-4C, the outlets of the second pressure-side turn passage 450" and the second suction-side turn passage 452" are separated from each other, with the outlet of the first passages 450', 452' located therebetween.

The third pressure-side turn passage 450'" and the third suction-side turn passage 452'" form a third turning feature that turns and orients the flows from the pressure and suction sides of the third up-pass 404*a*'" toward the merging chamber 464. The third turning feature also forms a generally tapered V-shape orientation as shown in the embodiment of FIGS. 4A-4C. Inlets of the respective third pressure-side turn passage 450'" and third suction-side turn passage 452'" are separated apart from each other (essentially separation between pressure side and suction side of the airfoil 402 at the ends of the third up-pass airfoil cavity 404*a*'"). As the third pressure-side turn passage 450'" and the third suction-side turn passage 452'" extend aftward from the respective inlets, the orientation of the passages 450'", 452'" taper or are angled inward toward each other until the passages 450'", 452'" merge or have outlets at the merging chamber 464. As shown in FIGS. 4B-4C, the outlets of the third pressure-side turn passage 450'" and the third suction-side turn passage 452''' are separated from each other, with the outlet of the first passages 450', 452' and the second passages 450'', 452'' located therebetween.

FIGS. 4B-4C illustrate the separation of the various turn passages and structure of the turn features in accordance with an embodiment of the present disclosure. As shown, the pressure and suction side turn passages of a turning feature are segregated by rib/wall dividers within the turn cap 442 (e.g., physical walls or ribs within the turn cap 442). That is, as shown in FIG. 4C, the first pressure-side turn passage 450' and the first suction-side turn passage 452' are separated by a first divider 454'. The first divider 454' extends from a leading edge (e.g., forward end) of the turn cap 442 toward a trailing edge (e.g., aft end) of the turn cap 442 and separates the first pressure-side turn passage 450' and the first suction-side turn passage 452'. As shown, the first divider 454' forms a complimentary shape to the separate and tapering or angling of the first pressure-side turn passage 450' and the first suction-side turn passage 452'. The first divider 454' defines walls of the first pressure-side turn passage 450' and the first suction-side turn passage 452' within the turn cap 442. In some embodiments, the first divider 454' can be a hollow, but sealed or enclosed, structure (e.g., to limit weight of the turn cap 442). The first pressure-side turn passage 450' and the first suction-side turn passage 452' are bounded by a second divider 454'' which defines an opposing wall of the first pressure-side turn passage 450' and the first suction-side turn passage 452'. As shown, the second divider 454'' comprises two portions and are positioned between the first turn passages 450', 452' and the second turn passages 450'', 452'', respectively.

Similarly, the second pressure-side turn passage 450'' and the second suction-side turn passage 452'' are separated by the second divider 454'' (and the first pressure-side turn passage 450', the first suction-side turn passage 452', and the first divider 454'). Each portion of the second divider 454'' extends from an exterior side wall 456 of the turn cap 442 toward an interior of the turn cap 442 to define walls of the first and second turn passages 450', 452', 450'', 452''. As shown, the second divider 454'' forms a complimentary shape to the separate and tapering or angling of the first and second turn passages 450', 452', 450'', 452''. The second pressure-side turn passage 450'' and the second suction-side turn passage 452'' are bounded by the second divider 454'' and a third divider 454'' which define the walls of the second pressure-side turn passage 450'' and the second suction-side turn passage 452''. As shown, the third divider 454''' comprises two portions that are positioned between the second turn passages 450'', 452'' and the third turn passages 450''', 452''', respectively.

The third pressure-side turn passage 450''' and the third suction-side turn passage 452''' are separated by the third divider 454'' (and the second turning feature, the first turning feature, and the first and second dividers 454', 454''). Each portion of the second divider 454'' extends from the exterior side wall 456 of the turn cap 442 toward an interior of the turn cap 442 to define walls of the second and third turn passages 450'', 452'', 450''', 452'''. As shown, the third divider 454''' forms a complimentary shape to the separate and tapering or angling of the second and third turn passages 450'', 452'', 450''', 452'''. The third pressure-side turn passage 450''' and the third suction-side turn passage 452''' are bounded by the third divider 454''' and the exterior side wall 456 of the turn cap 442, which define the walls of the third pressure-side turn passage 450''' and the third suction-side turn passage 452'''.

As will be appreciated by those of skill in the art in view of the illustrations of FIGS. 4A-4C, the dividers 454', 454'', 454''' are radially extending relative to the platform, airfoil, etc. That is, the dividers 454', 454'', 454''' within the turn cap 442 extend radially downward or inward from an exterior top wall 457 of the turn cap 442. The exterior top wall 457 extends circumferentially between the exterior side walls 456. Thus, the dividers 454', 454'', 454''' may be referred to herein as radial dividers or radially extending dividers.

Figure 5:
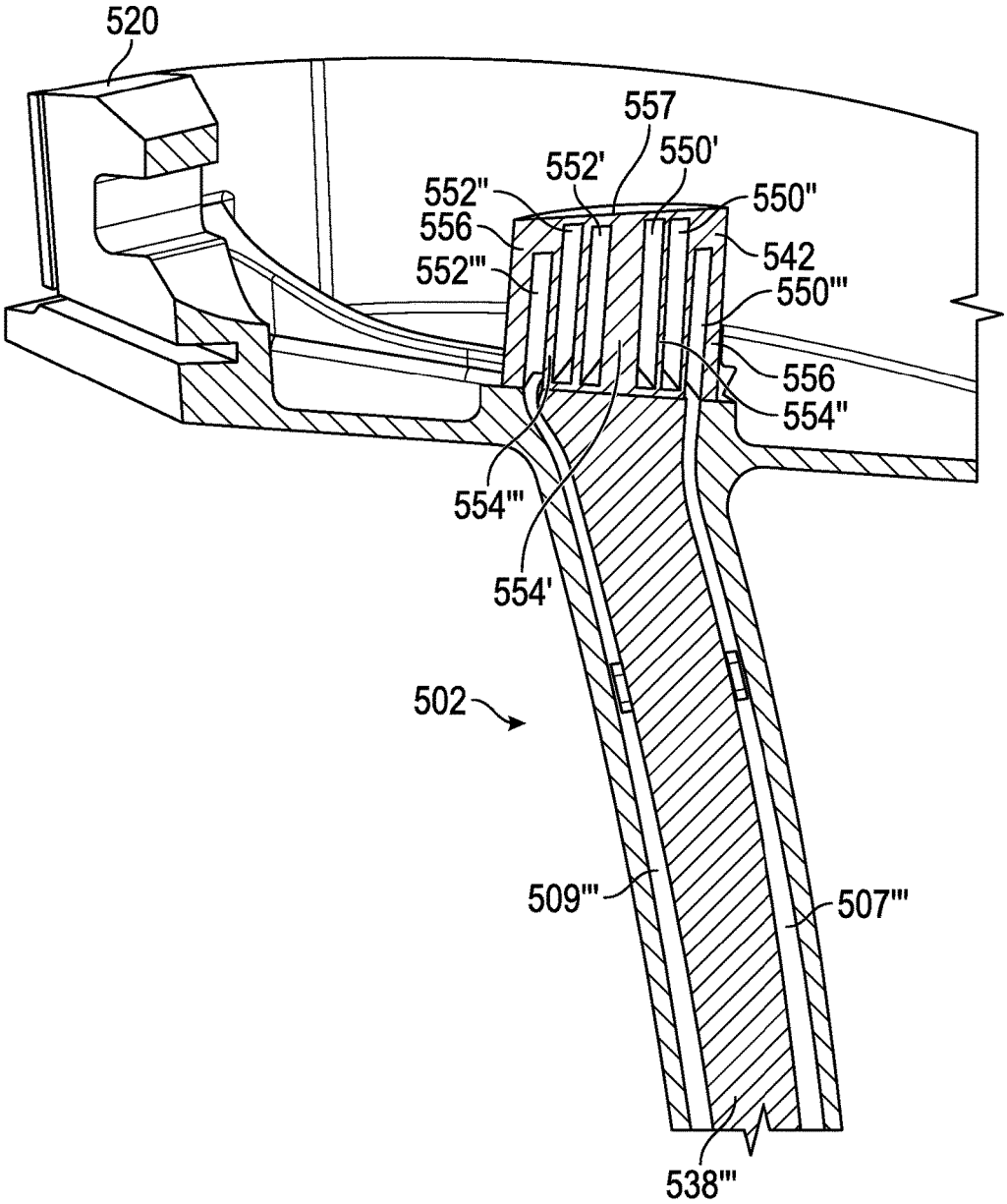
FIG. 5 is a schematic illustration of airflow passages within a turn cap and airfoil in accordance with an embodiment of the present disclosure.

Turning now to FIG. 5, a cross-section illustration of an airfoil 502 and platform 520 are schematically shown with a turn cap 542 installed thereon. The illustration in FIG. 5 is of an airfoil, platform, and turn cap similar to that shown and described above. As shown, the turn cap 542 includes a first turning feature (first pressure and suction side turn passages 550', 552'), a second turning feature (second pressure and suction side turn passages 550'', 552''), and a third turning feature (third pressure and suction side turn passages 550''', 552'''). The turn cap 542 includes exterior side walls 556, an exterior top wall 557, and radially extending dividers 554', 554'', 554''' that separate and define the various turning features as described above with respect to FIGS. 4A-4C.

In the view of FIG. 5, a pressure side airfoil passage 507''' and a suction side airfoil passage 509''' are shown supplying air into turn passages 550''', 552''' of the turn cap 542. In this illustration, the pressure side airfoil passage 507''' and a suction side airfoil passage 509''' represent third edge airfoil passages (e.g., up-pass airfoil passage 404*a*''' shown in FIG. 4A). The third pressure-side turn passage 550''' is supplied or fed with air that passes through the pressure side airfoil passage 507''' (e.g., part of third up-pass cavity 404*a*''' shown in FIG. 4A). Similarly, the third suction-side turn passage 552''' is supplied or fed with air that passes through a suction side airfoil passage 509''' (e.g., part of third up-pass cavity 404*a*''' shown in FIG. 4A). In the arrangement of FIG. 5, the pressure side airfoil passage 507''' is separated from the suction side airfoil passage 509''' by a baffle 538'''. Although not shown in detail, those of skill in the art will appreciate that first and second up-pass cavities and first and second down-pass cavities can include baffles that separate or divide the respective airfoil cavities into pressure and suction side airfoil passages similar to that shown in FIG. 5.

As noted above, the turn passages can merge into a merging chamber. The turn passages of each turning feature are arranged to turn and merge flows that feed into the merging chamber with the incoming flow (e.g., exiting the turning passages and entering the mixing chamber) being substantially parallel and thus losses can be minimized.

Figure 6A:
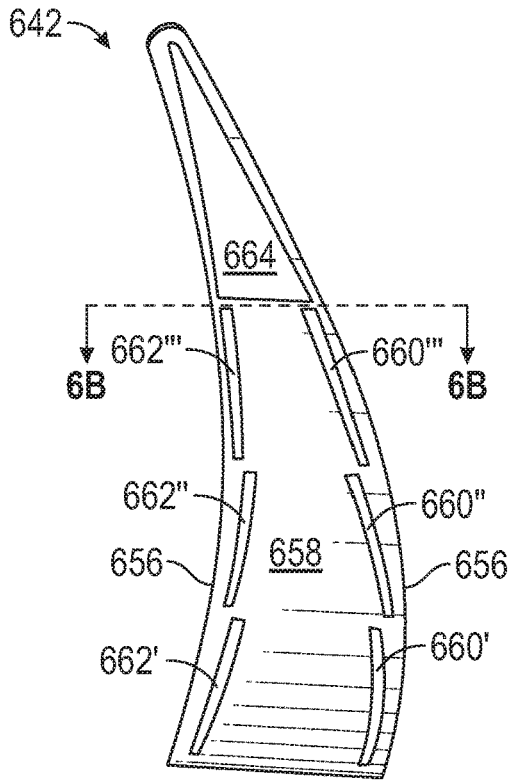
FIG. 6A is a bottom up, plan illustration of a turn cap in accordance with an embodiment of the present disclosure.
Figure 6B:
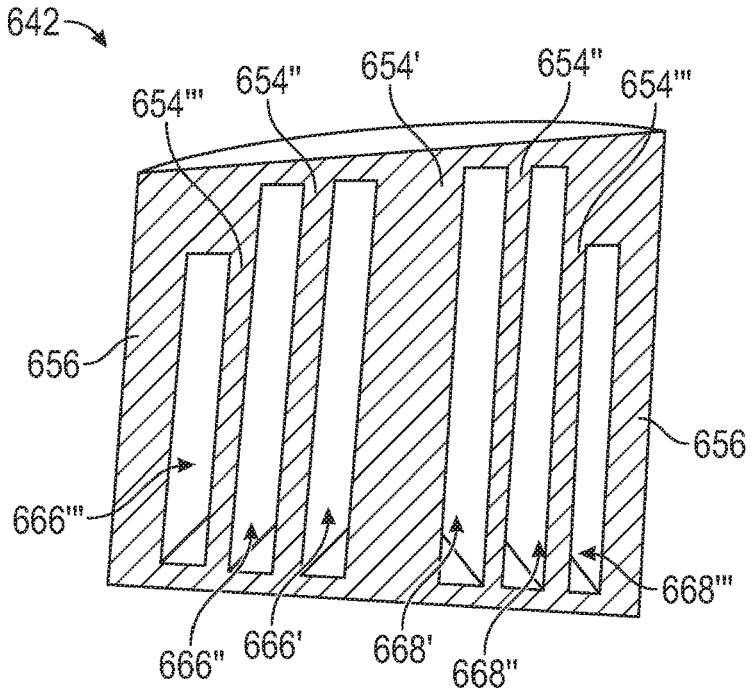
FIG. 6B is a cross-section illustration of the turn cap of FIG. 6A as viewed along the line 6B-6B shown in FIG. 6A.

Turning now to FIGS. 6A-6B, schematic illustrations of a turn cap 642 in accordance with an embodiment of the present disclosure are shown. FIG. 6A is a bottom, plan view illustration of the turn cap 642 and FIG. 6B is a cross-sectional illustration viewed along the line 6B-6B shown in FIG. 6A. The turn cap 642 includes a plurality of turning features that are arranged to enable turning of airflow from a first direction (e.g., radially outward from an airfoil) to a second direction (e.g., axially, aftward relative to the airfoil). For example, as shown in FIG. 6B, the turn cap 642 includes first pressure and suction side turn passages (forming a first turning feature), second pressure and suction side turn passages (forming a second turning feature), and third pressure and suction side turn passages (forming a third turning feature), similar to that shown and described above. The various turn passages are separated by dividers as described above, and as shown, including a first divider 654', a second divider 654'', and a third divider 654'''. The dividers 654', 654", 654'" and exterior side walls 656 define the sides or walls of the turn passages, as described above.

The turn cap 642 has a bottom surface 658 that can engage with and be fixed to a platform for an airfoil, as will be appreciated by those of skill in the art. The bottom surface 658 is arranged to allow selective entry of fluid into the turning features within the turn cap 642. For example, as shown in FIG. 6A, a first pressure side inlet 662' can be positioned over a pressure side portion of a first up-pass airfoil cavity to receive airflow therefrom and a first suction side inlet 660' can be positioned over a suction side portion of the first up-pass airfoil cavity to receive airflow therefrom. The first pressure and suction side inlets 662', 660' form inlets to the first turning feature (e.g., first pressure and suction side turn passages within the turn cap 642).

Similarly, a second pressure side inlet 662" can be positioned over a pressure side portion of a second up-pass airfoil cavity to receive airflow therefrom and a second suction side inlet 660" can be positioned over a suction side portion of the second up-pass airfoil cavity to receive airflow therefrom. The second pressure and suction side inlets 662", 660" form inlets to the second turning feature (e.g., second pressure and suction side turn passages within the turn cap 642).

Further, as shown, a third pressure side inlet 662'" can be positioned over a pressure side portion of a third up-pass airfoil cavity to receive airflow therefrom and a third suction side inlet 660'" can be positioned over a suction side portion of the third up-pass airfoil cavity to receive airflow therefrom. The third pressure and suction side inlets 662'", 660'" form inlets to the third turning feature (e.g., third pressure and suction side turn passages within the turn cap 642).

As discussed above, the turning features are configured to align airflow and then merge and/or mix the aligned airflows within a mixing chamber 664. The mixing chamber 664 can be positioned over one or more down-pass cavities within the airfoil to which the turn cap 642 is installed. As shown in FIG. 6B, each of the turning features has outlets that are fluidly connected to the mixing chamber 664. A first pressure side outlet 668' is fluidly connected to the first pressure side inlet 662' to form a first pressure side turning passage therebetween. A first suction side outlet 666' is fluidly connected to the first suction side inlet 660' to form a first suction side turning passage therebetween. The first pressure and suction side turning passages form a first turning feature within the turn cap 642.

A second pressure side outlet 668" is fluidly connected to the second pressure side inlet 662" to form a second pressure side turning passage therebetween. A second suction side outlet 666" is fluidly connected to the second suction side inlet 660" to form a second suction side turning passage therebetween. The second pressure and suction side turning passages form a second turning feature within the turn cap 642. Similarly, a third pressure side outlet 668'" is fluidly connected to the third pressure side inlet 662'" to form a third pressure side turning passage therebetween. A third suction side outlet 666'" is fluidly connected to the third suction side inlet 660'" to form a third suction side turning passage therebetween. The third pressure and suction side turning passages form a third turning feature within the turn cap 642.

As noted, the outlets 666, 668 are arranged to have fluid flow exiting therefrom and into the mixing chamber 664 to be aligned such that flow losses are minimized. The merged flows can then flow through the mixing chamber 664 and enter down-pass cavities within an airfoil.

As is apparent in FIG. 6A, each of the inlets 662, 660 is angled relative to each other within a set (e.g., first pressure and suction side inlets 662', 660'). Such angling can be provided to enable improved turning of the incoming air from the radial flow up-pass cavities. By maintaining the relative aspect ratio of the channels as the internal cooling flow transitions through the turning passages from radially oriented flow passages to predominantly axial oriented flow passages, the propensity for internal flow separation and increased pressure loss is significantly reduced. Additionally the angling of the individual pressure and suction side turn passages ensures that each turn passage is generally aligned in a predominantly axial streamwise direction. The transition of individual turn cavity flow areas also enables the distribution of exit velocities to be optimized as the flows enter the mixing chamber 664 in order to reduce and/or eliminate momentum mixing losses and undesirable pressure drop associated with the merging of cooling cavities of various mass flow rates, Mach numbers, and velocities. The radial turning passages within the turn caps of the present disclosure can be rotated slightly to allow the various passages to be stacked circumferentially within the turn cap (e.g., the orientation shown in FIG. 6B). Such rotated inlets 660, 662 can result in varying external wall thicknesses of both the turn cap and of the airfoil itself.

Figure 7A:
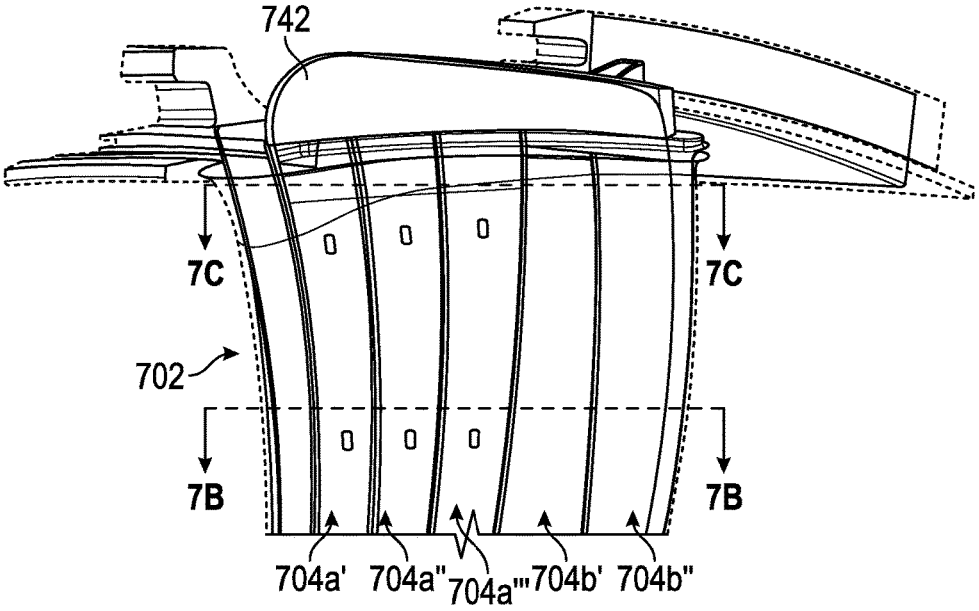
FIG. 7A is a schematic illustration of an airfoil and turn cap in accordance with an embodiment of the present disclosure.
Figure 7B:
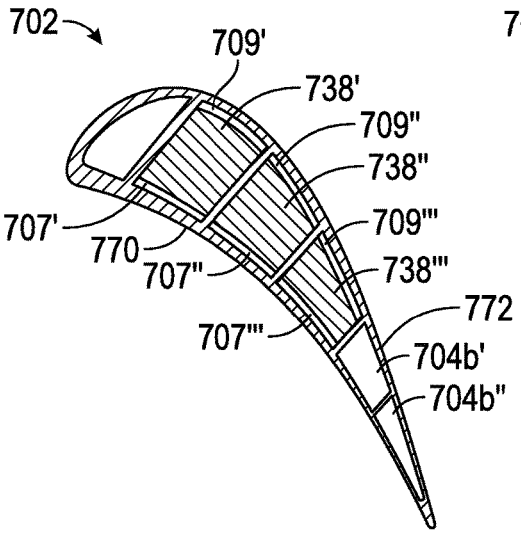
FIG. 7B is a cross-sectional illustration of the airfoil of FIG. 7A as viewed along the line 7B-7B of FIG. 7A.
Figure 7C:
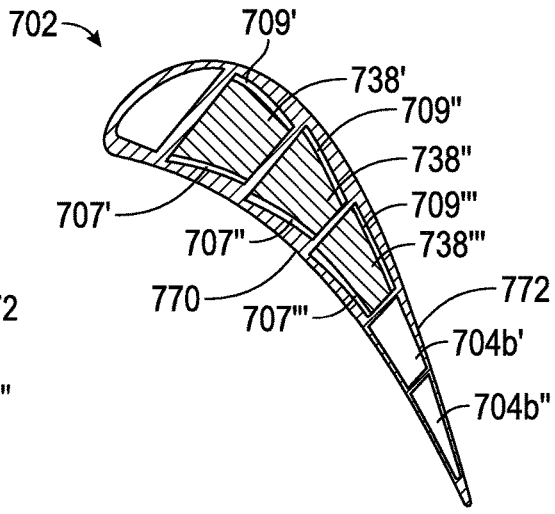
FIG. 7C is a cross-sectional illustration of the airfoil of FIG. 7A as viewed along the line 7C-7C of FIG. 7A.

For example, turning now to FIGS. 7A-7C, schematic illustrations of an airfoil 702 having a turn cap 742 in accordance with an embodiment of the present disclosure is shown. FIG. 7A is a side view illustration of the airfoil 702 and turn cap 742. FIG. 7B is a cross-sectional (radially inward) illustration of the airfoil 702 as viewed along the line 7B-7B shown in FIG. 7A. FIG. 7C is a cross-sectional (radially inward) illustration of the airfoil 702 as viewed along the line 7C-7C shown in FIG. 7A. As shown, the airfoil 702 includes up-pass cavities 704*a*', 704*a*", 704*a*'" and down-pass cavities 704*b*', 704*b*", with the up-pass and down-pass cavities fluidly connected by the turn cap 742.

As shown in FIGS. 7B-7C, the structure of the airfoil 702 can be varied in the radial direction, with the cross-section viewed along the line 7B-7B being radially inward from the cross-section viewed along the line 7C-7C of FIG. 7A. Each up-pass cavity 704*a*', 704*a*", 704*a*'" includes a respective baffle 738', 738", 738'", as will be appreciated by those of skill in the art. The interior surfaces of the up-pass cavity 704*a*', 704*a*", 704*a*'" is defined, in part, by an exterior wall of the airfoil 702. That is, a pressure side wall 770 of the airfoil 702 and a portion of the first baffle 738' define a first pressure side airfoil passage 707' and a suction side wall 772 of the airfoil 702 and a portion of the first baffle 738' defines a first suction side airfoil passage 709'. Similarly, the pressure side wall 770 of the airfoil 702 and a portion of the second baffle 738" define a second pressure side airfoil passage 707" and the suction side wall 772 of the airfoil 702 and a portion of the second baffle 738" defines a second suction side airfoil passage 709". The pressure side wall 770 of the airfoil 702 and a portion of the third baffle 738'" define a third pressure side airfoil passage 707'" and the suction side wall 772 of the airfoil 702 and a portion of the third baffle 738'" defines a third suction side airfoil passage 709'".

As shown in FIG. 7B, the exterior walls (pressure side wall 770, suction side wall 772) of the airfoil 702 are substantially uniform in thickness. Stated another way, the walls of the up-pass cavities 704*a*', 704*a*", 704*a*'" that are along the airfoil 702 side walls 770, 772 are parallel to airfoil external surfaces. Such parallel orientation can be present for a majority of the radial span of the airfoil 702, which results in a constant wall thickness of the airfoil along the up-pass cavities 704*a*', 704*a*", 704*a*'".

However, to accommodate the rotated or angled inlets of the turn cap 742 (e.g., if configured as shown in FIG. 6A), the shape and/or arrangement of the airfoil 702, the up-pass cavities 704*a*', 704*a*", 704*a*'", and/or the baffles 738', 738", 738'" may be modified to provide desired airflow characteristics and/or alignment between flow passages. That is, as shown in the comparison between FIG. 7B and FIG. 7C, ends of the up-pass cavities 704*a*', 704*a*", 704*a*'" are rotated slightly in order to align with inlets to turn passages within the turn cap 742. Further, such arrangement enables the staggered or stacked arrangement of turn passages as shown in FIGS. 6A-6B. Such modification can result in varying external wall thicknesses of the turn cap 742 and/or the airfoil 702, as illustratively shown in FIG. 7C.

Figure 8:
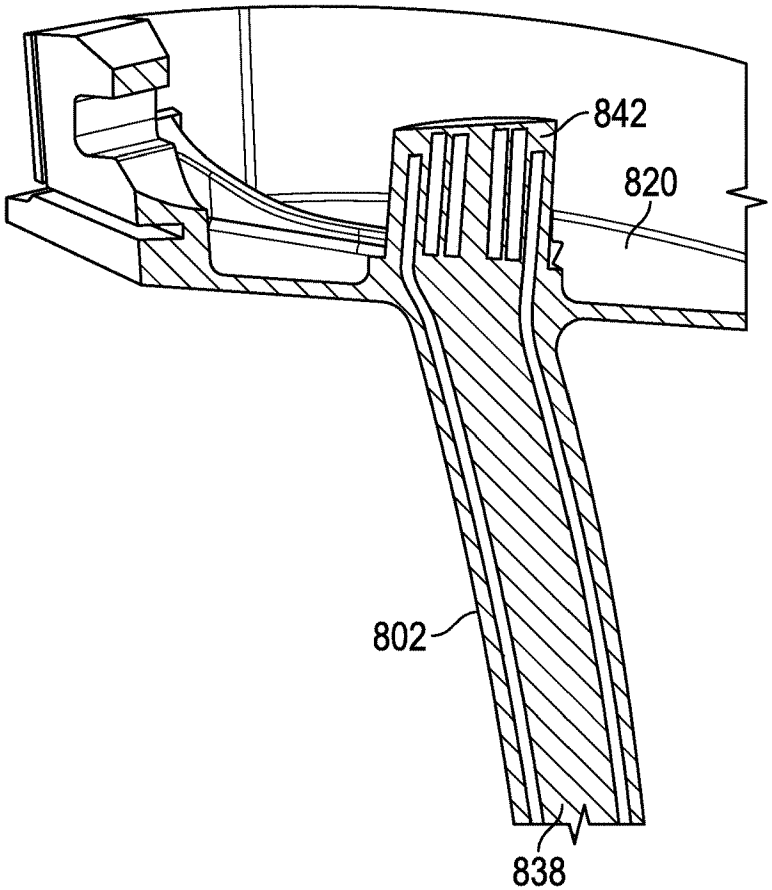
FIG. 8 is a schematic illustration of an integrally formed turn cap and airfoil in accordance with an embodiment of the present disclosure.

Turning now to FIG. 8, a schematic illustration of an integrally cast turn cap 842 configuration is shown. The integrally cast configuration includes a structure that is formed during a casting process that forms an airfoil 802, a platform 820, and the turn cap 842. As shown, the airfoil 802 includes a baffle 838 integrally formed therein, with the baffle 838 held within the airfoil 802 by stand-off elements, as will be appreciated by those of skill in the art. As schematically shown, the airfoil 802 and the turn cap 842 include airflow passages (airfoil and turn cap) as described herein. The configuration shown in FIG. 8 is integrally formed using a casting process. The casting process can be one that is typically used for forming airfoils and features thereof, as will be appreciated by those of skill in the art. In another embodiment, the integral configuration shown in FIG. 8 can be manufactured using additive manufacturing processes.

Figure 9:
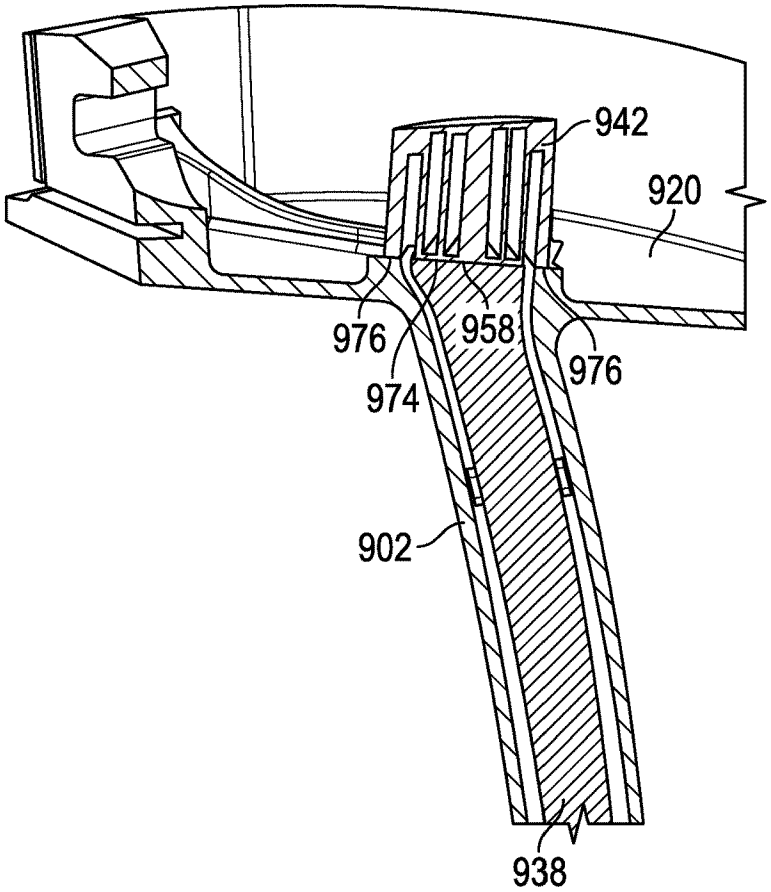
FIG. 9 is a schematic illustration of a turn cap and airfoil that are separately formed and then combined in accordance with an embodiment of the present disclosure.

Turning now to FIG. 9, a schematic illustration of a configuration having separately formed and joined features is shown. The configuration includes structures that are formed during one or more casting or other manufacturing processes and then assembled to form a complete component. The separately formed structures, as shown, include an airfoil 902, a platform 920, and a turn cap 942 that are joined and then installed within a gas turbine engine. In the presently shown arrangement the airfoil 902 and the platform 920 are integrally formed, and the turn cap 942 is a separate component attached thereto. The airfoil 902 includes a baffle 938 that can be integrally formed therein or separately formed and installed in a traditional manner. The baffle 938 can be held within the airfoil 902 by stand-off elements, as will be appreciated by those of skill in the art. In one assembly process, the baffle 938 is installed within an airfoil cavity of the airfoil 902 and then the turn cap 942 is welded, brazed, or otherwise attached to the platform 920. As schematically shown, the airfoil 902 and the turn cap 942 include airflow passages as described herein.

As noted, the configuration shown in FIG. 9 is formed from multiple separate components. The various components can be formed using casting processes, additive manufacturing, etc. The separate components can then be joined or attached as known in the art. As schematically shown in FIG. 9, the baffle 938 has a baffle surface 974 that is complimentary with the bottom surface 958 of the turn cap 942 (e.g., as shown in FIG. 6A) which may be joined together using welding, brazing, etc. In some embodiments, the turn cap bottom surface 958 is configured to hold or retain the baffle 938 within the airfoil 902, even if the baffle 938 is not attached to the turn cap 942. That is, the bottom surface 958 of the turn cap 942 can be arranged to stop the baffle 938 from radial movement when the baffle surface 974 contacts the bottom surface 958 of the turn cap 942. In some embodiments, the baffle 938 can be integrally formed with the turn cap 942 and installed into the airfoil 902 as a single unit. The platform 920 includes platform surfaces 976 to which the turn cap 942 can be fixedly connected or attached (e.g., welded, brazed, etc.). Advantageously, a separately formed turn cap can enable modification during development without having to change a casting process of the airfoil, platform, and/or baffle.

Figure 10A:
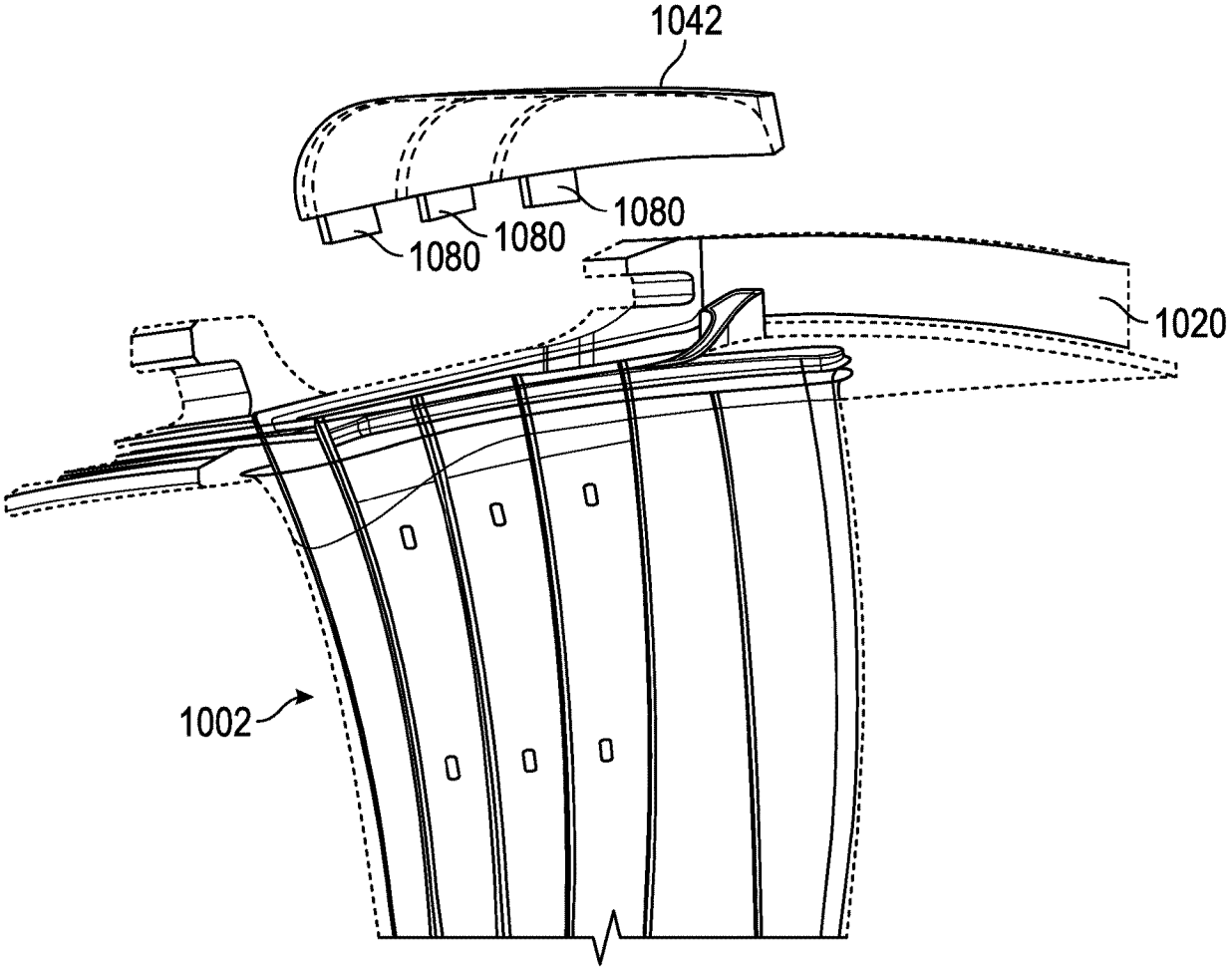
FIG. 10A is a schematic illustration of a turn cap having alignment tabs to enable installation of the turn cap to an airfoil in accordance with an embodiment of the present disclosure.
Figure 10B:
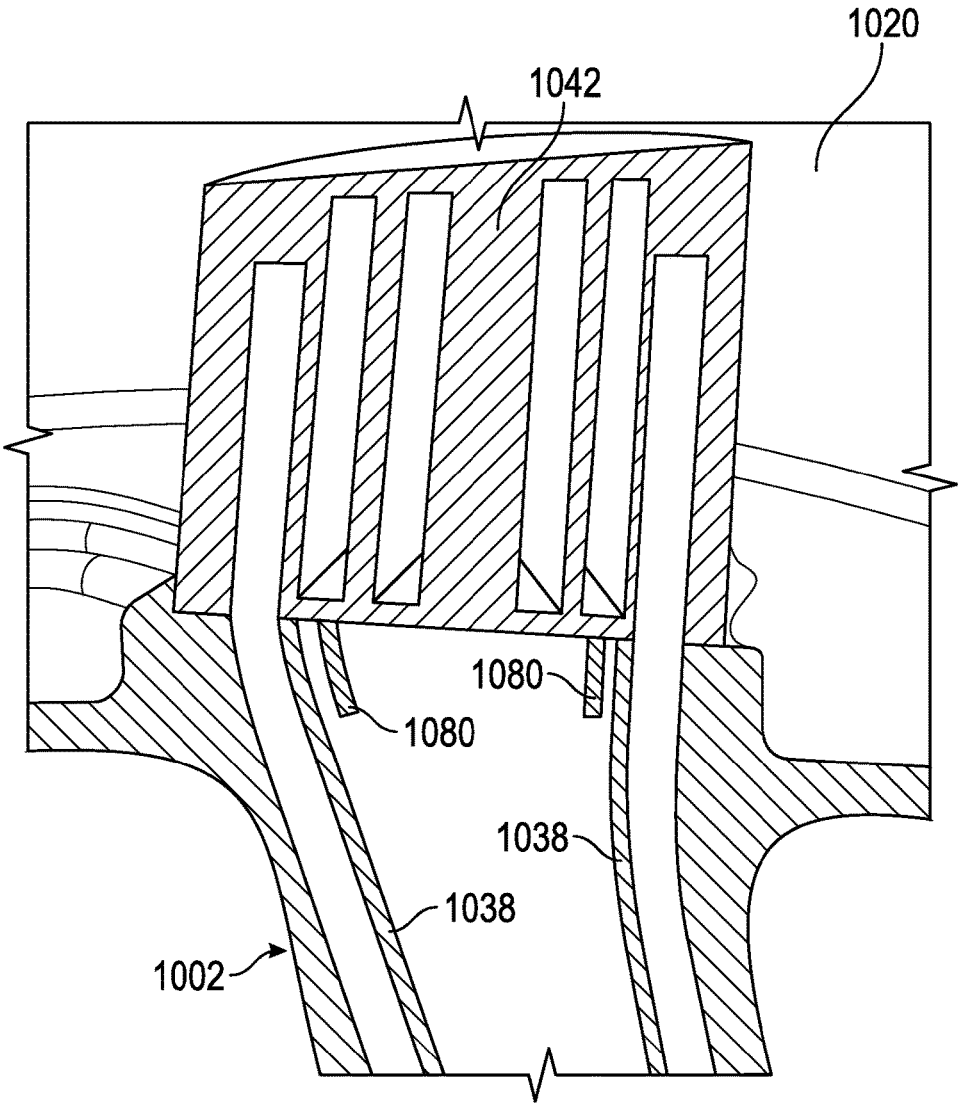
FIG. 10B is a schematic illustration of the turn cap and airfoil of FIG. 10A joined together.

Turning now to FIGS. 10A-10B, schematic illustrations of an installation process of a turn cap 1042 on to a platform 1020 of an airfoil 1002 are shown. In the embodiment of FIGS. 10A-10B, the turn cap 1042 includes one or more alignment tabs 1080 for aiding in positioning the turn cap 1042 relative to the airfoil 1002 and the airfoil cavities therein. In such an embodiment, a baffle 1038 may be hollow such that the alignment tabs 1080 can fit within the baffle 1038. In other embodiments, the baffles can include slots to receive the alignment tabs 1080. For positioning purposes only a single alignment tab 1080 may be needed, however, as shown, the turn cap 1042 can include multiple alignment tabs 1080. In other embodiments, the baffle, the platform, and/or the airfoil can include alignment tabs and the turn cap can include one or more slots to receive the alignment tabs.

In view of the above, as provided herein, turn caps (or portions thereof) are formed as separate piece(s) and joined to the airfoil platform casting or may be integrally formed therewith. In some configurations, optional "space-eater" baffles can be inserted into airfoil cavities before attaching the turn cap or may be integrally formed with the airfoil or the turn cap. The turn caps, as provided herein, may be cast, additively manufactured, formed from sheet metal, or manufactured by other means.

Although various embodiments have been shown and described herein regarding turn caps for airfoils, those of skill in the art will appreciate that various combinations of the above embodiments, and/or variations thereon, may be made without departing from the scope of the invention. For example, a single airfoil may be configured with more than one turn cap with each turn cap connecting two or more adjacent airfoil cavities.

Advantageously, embodiments described herein provide turn caps that may be fixedly attached to (or integrally formed with) non-gas path surfaces of airfoil platforms to fluidly connect airfoil cavities of the airfoil and aid in turning airflow passing therethrough. Such turn caps can be used with serpentine flow paths within airfoils such that at least one up-pass and at least one down-pass of the serpentine cavity can be fluidly connected in external cavities outside of the core flow path of the gas turbine engine. The turn caps include axial and radially extending turn passages that each receives fluid flow from respective airfoil cavities. The air is turned within the turn passages and aligned such that efficient flow merging can be achieved within a merging chamber.

Further, advantageously, such turn caps allow for installation of "space-eater" baffles into curved airfoils, such as bowed vanes, without interference with manufacturing requirements. Furthermore, advantageously, turn caps as provided herein can operate as stop structures to constrain and/or prevent radial, axial, and/or circumferential movement of the "space eater" baffles relative to the cooling channels and adjacent airfoil external side walls and ribs in which they are inserted to ensure optimal convective cooling, pressure loss, and thermal performance is maintained.

Moreover, advantageously, embodiments provided herein keep cooling flow streams in each passage separated until all of the flow streams have turned axial and are aligned in the same direction, eliminating pressure losses associated with turbulence caused by the merging of flow streams in different directions. In addition, advantageously, a means of transitioning the cooling passages from an axial aspect ratio to a radial aspect ratio in order to fit all of the passages within the turn cap is provided.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although shown with bowed vanes, those of skill in the art will appreciate that airfoils manufactured in accordance with the present disclosure are not so limited. That is, any airfoil where it is desired to have a turn path formed exterior to an airfoil body can employ embodiments described herein.

Furthermore, although shown and described with a single merging chamber, in some embodiment multiple merging chambers can be provided within a turn cap, and each merging chamber can be fluidly isolated from other merging chambers. Moreover, in some embodiments, the forward-most turn passage and the airfoil passage feeding the forward-most turn passage (e.g., first up-pass airfoil cavity) can be fully open (e.g., no "space eater" baffle in first up-pass airfoil cavity). Further, in some embodiments, the bottom surface 658 (shown in FIG. 6A) may be open between the first pressure and suction side inlets 660', 662' to form a relatively large opening. In such arrangement, the forward most turn passage may be wide open (and substantially prism-shaped) and the first up-pass feeding the forward most turn passage may have a low-loss "space eater" baffle that allows flow to diffuse with minimal pressure loss.

Accordingly, the present disclosure is not to be seen as limited by the foregoing description, but is only limited by the scope of the appended claims.

What is claimed is:

1. A vane of a gas turbine engine comprising:

a hollow body having a pressure side and a suction side and the hollow body having a first up-pass cavity and a first down-pass cavity, the hollow body having an inner diameter end and an outer diameter end, the first up-pass cavity including a first pressure side airfoil passage arranged along the pressure side of the hollow body and a first suction side airfoil passage arranged along the suction side of the hollow body, the first up-pass cavity having a flow direction from the inner diameter end toward the outer diameter end and the first down-pass cavity having a flow direction from the outer diameter end toward the inner diameter end, the first down-pass cavity defined between external walls of the pressure side and the suction side of the hollow body;

a first airfoil platform arranged at the outer diameter end of the hollow body, the first airfoil platform having a gas path surface and a non-gas path surface, wherein the hollow body extends from the gas path surface of the first airfoil platform;

a first up-pass cavity opening formed in the non-gas path surface of the first airfoil platform fluidly connected to the first up-pass cavity;

a first down-pass cavity opening formed in the non-gas path surface of the first airfoil platform fluidly connected to the first down-pass cavity; and a first turn cap fixedly attached to the first airfoil platform on the non-gas path surface covering the first up-pass cavity opening and the first down-pass cavity opening of the first airfoil platform, the first turn cap having:

exterior side walls, the exterior side walls extending between a forward-end of the turn cap and an aft-end of the turn cap;

an exterior top wall extending between the exterior side walls and between the forward-end and the aft-end of the turn cap; and a first divider located within the first turn cap extending from the exterior top wall and positioned between the exterior side walls and defining a first suction-side turn passage between the exterior side wall and the first divider and a first pressure-side turn passage between the exterior side wall and the first divider, wherein the first divider fluidly separates the first pressure-side turn passage from the first suction-side turn passage within the first turn cap, wherein the first divider extends from the forward-end of the turn cap toward the aft-end of the turn cap and separates the first pressure-side turn passage and the first suction-side turn passage, wherein a merging chamber is formed in the turn cap proximate the aft-end of the turn cap, wherein, in operation, a fluid flow passes radially through the first pressure side airfoil passage of the first up-pass cavity into the first pressure-side turn passage proximate the forward-end of the turn cap and fluid flows radially through the first suction side airfoil passage of the first up-pass cavity into the first suction-side turn passage proximate the forward-end of the turn cap, wherein, in operation, the fluid flow flows axially once entering the respective first pressure-side turn passage and first suction-side turn passage toward the aft-end of the turn cap, wherein, in operation, the fluid flow passing-flows axially through the first suction side turn passage and the first pressure side turn passage and are merged at the merging chamber in an axial direction proximate the aft-end of the turn cap, and wherein, in operation, the fluid flow is turned from an axial flow to a radial flow within the merging chamber and directed radially into the first down-pass cavity of the hollow body.

2. The vane of claim 1, further comprising:

a second up-pass cavity within the hollow body having a second pressure-side airfoil passage and a second suction-side airfoil passage and a second up-pass cavity opening is formed in the non-gas path surface of the first airfoil platform, wherein the second up-pass cavity is arranged between the first up-pass cavity and the first down-pass cavity, a second divider within the first turn cap and extending from the exterior top wall and positioned between the exterior side walls and the first divider and defining a second suction side turn passage fluidly connected with the second suction-side airfoil passage and a second pressure side turn passage fluidly connected with the second pressure-side airfoil passage, wherein fluid flows through the second suction side turn passage and the second pressure side turn passage are fluidly separated from each other and the fluid flows through the second pressure side turn passage and the second suction side turn passage and are merged at the merging chamber.

3. The vane of claim 1, wherein the first pressure-side turn passage and the first suction-side turn passage are each fluidly connected to a respective one of the radially extending up-pass cavities, wherein each radially extending up-pass cavity has a low aspect ratio, and wherein the first pressure-side turn passage and first suction-side turn passage each define axially extending turn passages having the same aspect ratios as the respective one of the radially extending up-pass cavities.

4. The vane of claim 1, wherein the hollow body further includes a second up-pass cavity having a second pressure side airfoil passage and a second suction side airfoil passage, wherein the second up-pass cavity is arranged between the first up-pass cavity and the first down-pass cavity within the hollow body, a second up-pass cavity opening is formed in the non-gas path surface of the first airfoil platform, and the first turn cap comprises:

a second pressure-side turn passage fluidly connecting the second pressure side airfoil passage to the merging chamber when the turn cap is attached to the first airfoil platform; and a second suction-side turn passage fluidly connecting the first suction side airfoil passage to the merging chamber when the turn cap is attached to the first airfoil platform, wherein each of the second suction-side turn passage and the second pressure-side turn passage are configured, during operation, to turn a direction of fluid flow from a radial direction to an axial direction such that a fluid flow exiting the second suction-side turn passage and the second pressure-side turn passage are aligned in an axial direction when entering the merging chamber.

5. The vane of claim 1, wherein the hollow body, the first airfoil platform, and the first turn cap are integrally formed.

6. The vane of claim 1, wherein the first up-pass cavity defines a first geometry within the hollow body such that an airfoil external wall of the hollow body is uniform in thickness at a first radial position and a second geometry within the hollow body such that the airfoil external wall of the hollow body is non-uniform in thickness at a second radial position.

7. The vane of claim 6, wherein the second radial position is proximate the first airfoil platform.

8. The vane of claim 1, further comprising a baffle positioned in the first up-pass cavity, the baffle defining the first pressure side airfoil passage along the pressure side of the hollow body and the first suction side airfoil passage along the suction side of the hollow body between the baffle and respective airfoil external walls.

9. The vane of claim 1, wherein the first pressure-side turn passage and the first suction-side turn passage are angled inward from the exterior side walls toward each other within the turn cap in a direction from the forward-end of the turn cap toward the aft-end of the turn cap.

10. The vane of claim 9, wherein the turn cap further comprises a second pressure-side turn passage and a second suction-side turn passage, wherein a second divider fluidly separates the second turn passages from the first turn passages.

11. The vane of claim 1, wherein the first pressure-side turn passage fluidly connects the first pressure side airfoil passage to the merging chamber when the turn cap is attached to the first airfoil platform and the first suction-side turn passage fluidly connects the first suction side airfoil passage to the merging chamber when the turn cap is attached to the first airfoil platform, wherein each of the first suction-side turn passage and the first pressure-side turn passage are configured to turn a direction of fluid flow from a radial direction within the respective airfoil passages to an axial direction within the turn cap such that a fluid flow exiting the first suction-side turn passage and the first pressure-side turn passage are aligned in an axial direction when entering the merging chamber.

12. The vane of claim 1, the turn cap further comprising at least one alignment tab extending from the turn cap to aid in positioning the turn cap relative to the hollow body or the first airfoil platform.

* * * * *